US010227110B1

(12) United States Patent
Valence et al.

(10) Patent No.: US 10,227,110 B1
(45) Date of Patent: Mar. 12, 2019

(54) RETRACTABLE ANCHOR FIXTURES

(71) Applicant: BOMBARDIER RECREATIONAL PRODUCTS INC., Valcourt (CA)

(72) Inventors: Maxime Valence, Saint-Cesaire (CA); Etienne Girard, Eastman (CA); Kim Ross, Valcourt (CA); Jonathan Desmeules, Sherbrooke (CA)

(73) Assignee: BOMBARDIER RECREATIONAL PRODUCTS INC., Valcourt (CA)

( * ) Notice: Subject to any disclaimer, the term of this patent is extended or adjusted under 35 U.S.C. 154(b) by 0 days.

(21) Appl. No.: 15/583,223

(22) Filed: May 1, 2017

Related U.S. Application Data

(60) Provisional application No. 62/329,738, filed on Apr. 29, 2016.

(51) Int. Cl.

| | |
|---|---|
| ***B63B 21/50*** | (2006.01) |
| ***B63B 35/73*** | (2006.01) |
| ***B63H 11/04*** | (2006.01) |
| ***B63B 29/04*** | (2006.01) |

(52) U.S. Cl.
CPC ..... *B63B 21/50* (2013.01); *B63B 29/04* (2013.01); *B63B 35/731* (2013.01); *B63H 11/04* (2013.01); *B63B 2029/043* (2013.01); *B63B 2751/00* (2013.01)

(58) Field of Classification Search
CPC ..... B63B 21/50; B63B 29/04; B63B 35/731
See application file for complete search history.

(56) References Cited

U.S. PATENT DOCUMENTS

| | | | |
|---|---|---|---|
| 4,809,634 | A | 3/1989 | Czipri |
| 8,777,531 | B2 | 7/2014 | Massicotte et al. |
| 8,833,289 | B2 | 9/2014 | Isaac |
| 8,875,830 | B2 | 11/2014 | Massicotte et al. |
| 9,120,536 | B2 | 9/2015 | Isaac |
| 2014/0319306 | A1 | 10/2014 | Massicotte et al. |
| 2015/0053733 | A1 | 2/2015 | Massicotte et al. |
| 2015/0210355 | A1 | 7/2015 | Labbe et al. |

OTHER PUBLICATIONS

Shaw, "Shoreline Yamaha Creates Possibly the Perfect Swiss Army Knife PWC Storage Rack", The Watercraft Journal, 2016, retrieved on Internet on May 2, 2017.
"How to set up a Jetski for fishing" by Jetski FishingShow (YouTube), available Dec. 17, 2011 [online], [site visited May 2, 2017] Video available from Internet, URL: https://www.youtube.com/watch?v=Olh-2Pk8MxU&feature=youtu.be.

*Primary Examiner* — Stephen P Avila
(74) *Attorney, Agent, or Firm* — BCF LLP

(57) ABSTRACT

A retractable anchor fixture for vehicle accessories is described. The retractable anchor fixture is adapted for being movably disposed in a surface aperture in a vehicle surface and comprises a fixture body, a fixture base extending from the fixture body, the fixture base including a stopper portion adapted for abutting an edge of the surface aperture, a first aperture defined by the fixture body, the first aperture being adapted to receive therethrough a portion of an anchor for anchoring an accessory to the anchor fixture, and an anchor chamber defined by the fixture body and communicating with the first aperture. An anchor fixture system and a vehicle providing a retractable anchor fixture are also described.

20 Claims, 18 Drawing Sheets

120
150
152
122
154
160
166
180
184
182
178
164
128
156
212
216
214
210
208
126
158
112
152
152
152

RETRACTABLE ANCHOR FIXTURES

CROSS-REFERENCE

The present application claims priority to U.S. Provisional Patent Application No. 62/329,738 filed on Apr. 29, 2016, the entirety of which is incorporated herein by reference.

TECHNICAL FIELD

The present technology relates to a retractable anchor fixture, a vehicle having retractable anchor fixture and a method for installing a vehicle accessory on a vehicle using retractable anchor fixtures.

BACKGROUND

Personal watercraft typically include a front storage bin, and can additionally include a glove box and/or an under-seat storage. It is also known for users of such vehicles to affix containers, racks and the like for additional fuel, specialized articles such as fishing rods, cargo that needs to be kept cool such as food or bait, or miscellaneous accessories such as personal items, equipment, and the like. Such additional containers, racks and the like are often secured to parts of the vehicles by ropes, cords, straps, tie-downs and the like, or bolted down directly to the vehicle's deck.

This is not, however, a convenient method for transporting objects on a personal watercraft. Jerks and bumps experienced during travel can sometimes result in objects shifting within the spaces in which they were placed, or loosening from the grips of the tying cords. Further, drilling holes through the deck to bolt down a container, rack or the like is undesirable. An anchoring system that protrudes from its surrounding surface when not in use, however, could impede other activities of riders and users of the personal watercraft when the anchoring system is not otherwise needed.

Therefore, there is a need for a versatile system for attaching items to a vehicle, including a personal watercraft.

SUMMARY

It is an object of the present to ameliorate at least some of the inconveniences present in the prior art.

According to an aspect of the present technology, there is provided a retractable anchor fixture for vehicle accessories, the retractable anchor fixture being adapted for being movably disposed in a surface aperture in a vehicle surface, the retractable anchor fixture including a fixture body; a fixture base extending from the fixture body, the fixture base including a stopper portion adapted for abutting an edge of the surface aperture; a first aperture defined by the fixture body, the first aperture being adapted to receive therethrough a portion of an anchor for anchoring a first vehicle accessory to the anchor fixture; and an anchor chamber defined by the fixture body and communicating with the first aperture.

In some implementations, the fixture further includes a second aperture defined at least in part by the fixture body and communicating with the anchor chamber, the second aperture being adapted to receive at least a portion of a fastener therein for fastening a second vehicle accessory to the anchor fixture.

In some implementations, the fixture further includes at least one resilient element being adapted for aiding in maintaining the retractable anchor fixture in a first position or a second position.

In some implementations, at least a portion of the anchor chamber being disposed outwardly of the first aperture in a direction perpendicular to a central axis of the first aperture; and the first aperture has an elongate shape.

In some implementations, a central axis of the second aperture is generally perpendicular to a central axis of the first aperture.

In some implementations, the first aperture is defined in a surface of the fixture body opposite to the fixture base.

In some implementations, the first aperture is defined in a surface of the fixture body perpendicular to the fixture base.

In some implementations, the second aperture is defined in a surface of the fixture body opposite to the fixture base.

In another broad aspect of the present technology, there is provided an anchor fixture system for vehicle accessories including at least one anchor fixture according to the above; and at least one anchor having an anchor base and an anchor lock extending from the anchor base; wherein the anchor is adapted to selectively engage the anchor fixture wherein at least a portion of the fixture body adjacent to the first aperture is held between the anchor lock and the anchor base; the anchor lock is rotatable about an axis generally perpendicular to the anchor base between an unlocked position wherein the anchor lock is movable through the first aperture of the anchor fixture and a locked position wherein the anchor lock is prevented from being movable through the first aperture; and the anchor lock is rotatable in the anchor chamber, between the unlocked position and the locked position.

In yet another broad aspect of the present technology, there is provided a vehicle including a vehicle body having at least one external surface; at least one seat connected to the vehicle body; a propulsion system connected to the vehicle body; at least one surface aperture being defined by the at least one external surface, the at least one surface aperture having an edge; at least one retractable anchor fixture movably disposed in the at least one surface aperture, the at least one retractable anchor fixture including a fixture body; a fixture base extending from the fixture body, the fixture base including a stopper portion for abutting at least a portion the edge of the at least one surface aperture; a first aperture defined by the fixture body, the first aperture being adapted to receive therethrough an anchor of a first vehicle accessory; and an anchor chamber defined by the fixture body and communicating with the first aperture, a central axis of the anchor aperture being normal to the anchor aperture.

In some implementations, the at least one surface aperture is defined by at least one recess, the at least one recess being defined by the at least one external surface.

In some implementations, the at least one retractable anchor fixture is movable between at least an extended position and a retracted position; in the retracted position, a top surface of the fixture body is generally aligned with, or generally below, a portion of the at least one external surface surrounding the edge of the at least one recess; and in the extended position, the stopper portion of the fixture base abuts the edge of the at least one recess.

In some implementations, the at least one retractable anchor fixture further comprises a second aperture defined at least in part by the fixture body and communicating with the anchor chamber, the second aperture being adapted to receive a portion of a fastener for fastening a second vehicle accessory to the anchor fixture.

In some implementations, the vehicle further includes at least one flange disposed within the at least one recess; and the at least one retractable anchor fixture further comprises at least one tab, the at least one tab being at least partially deformable, the at least one tab being generally aligned with the at least one flange.

In some implementations, a bottom portion of the at least one tab is disposed above the stopper portion; and when in the extended position the bottom portion of the at least one tab is abuts a top side of the edge of the at least one recess, and the stopper portion abuts a bottom side of the edge of the at least one recess.

In some implementations, the at least one recess is a first recess and a second recess, the first and second recessed being defined by the at least one external surface, the first and second recesses being spaced by a gap; and the at least one retractable anchor fixture is a first retractable anchor fixture and a second retractable anchor fixture, the first retractable anchor fixture being disposed in the first recess and the second retractable anchor fixture being disposed in the second recess.

In some implementations, the first and second anchor fixtures are oriented with the second apertures facing each other.

In some implementations, the first and second anchor fixtures are oriented with the first apertures facing each other.

In some implementations, the vehicle is a personal watercraft; the at least one recess is a pair of recesses defined in the rear platform; and the at least one retractable anchor fixture is a pair of retractable anchor fixtures disposed in the pair of recesses defined by the rear platform of the personal watercraft, the retractable anchor fixtures being disposed on opposite sides of the rear platform and oriented with their corresponding second apertures facing each other.

In some implementations, the at least one recess is a pair of recesses defined in the rear platform; the at least one retractable anchor fixture is a pair of retractable anchor fixtures disposed in the pair of recesses defined by the rear platform of the personal watercraft, the retractable anchor fixtures being disposed on opposite sides of the rear platform and oriented with their corresponding first apertures facing each other.

For purposes of this application, terms related to spatial orientation such as forwardly, rearward, upwardly, downwardly, left, and right, are as they would normally be understood by a driver of the vehicle sitting thereon in a normal riding position. Terms related to spatial orientation when describing or referring to components or sub-assemblies of the vehicle, separately from the vehicle, such as a deck or hull for example, should be understood as they would be understood when these components or sub-assemblies are mounted to the vehicle, unless specified otherwise in this application. The term "straddle-type seat" refers to a seat on which a person normally sits astride. The term "motor" can refer to any component capable of driving the motion of a watercraft, which includes but is not limited to an internal combustion engine or an electric motor.

Explanations and/or definitions of terms provided in the present application take precedence over explanations and/or definitions of these terms that may be found in the document incorporated herein by reference.

Implementations of the present technology each have at least one of the above-mentioned object and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects, and advantages of implementations of the present technology will become apparent from the following description, the accompanying drawings, and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

Retractable anchor fixtures, an anchoring system employing a retractable anchor fixture and a method of connecting a container using retractable anchor fixtures will be described with respect to a personal watercraft. However, it is contemplated that retractable anchor fixtures could be used on different types of vehicles, such as snowmobiles, side-by-side vehicles (SSVs), all-terrain vehicles (ATVs), other waterborne vessels or on-road vehicles.

Figure 1:
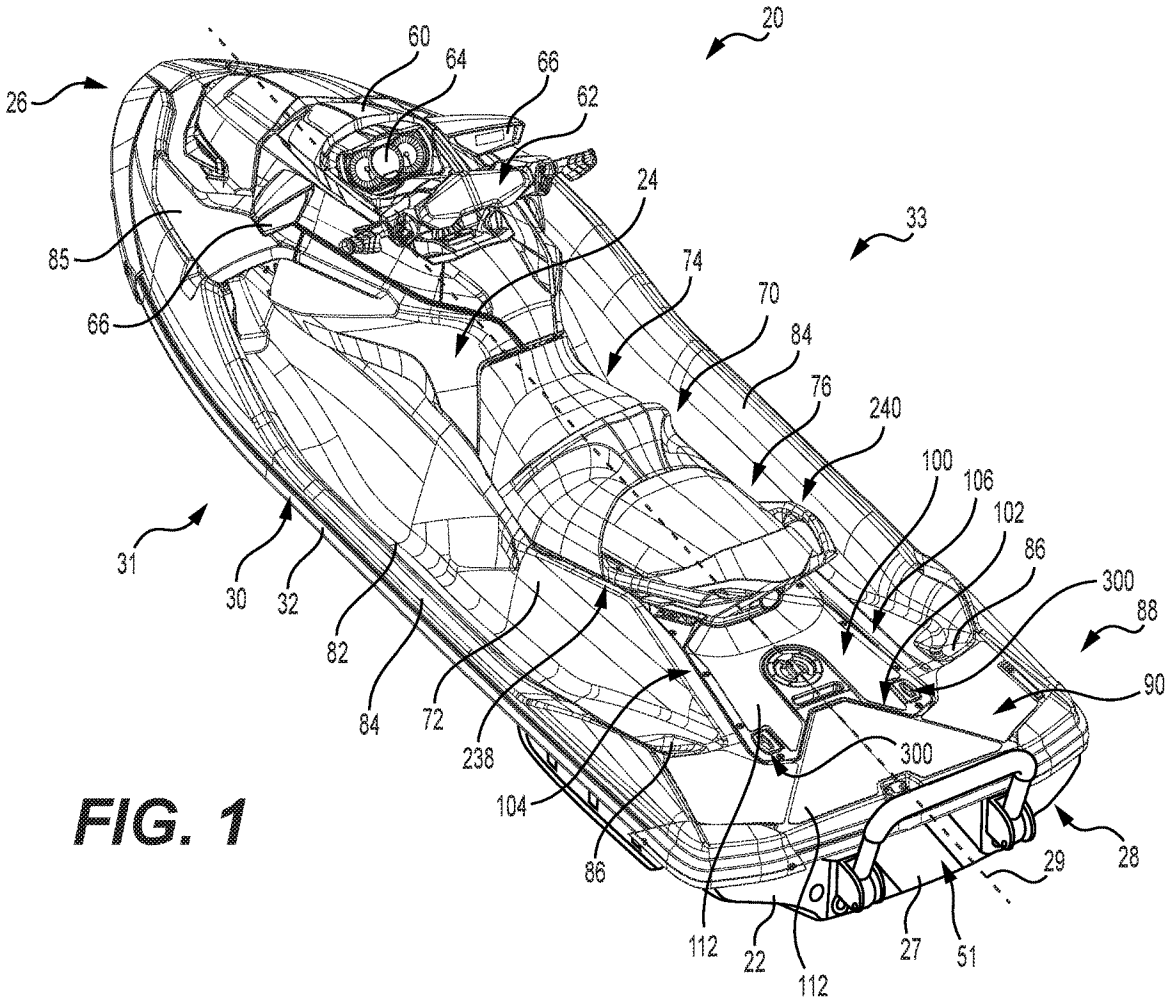
FIG. 1 is a top, left, rear side perspective view of a personal watercraft.
Figure 2:
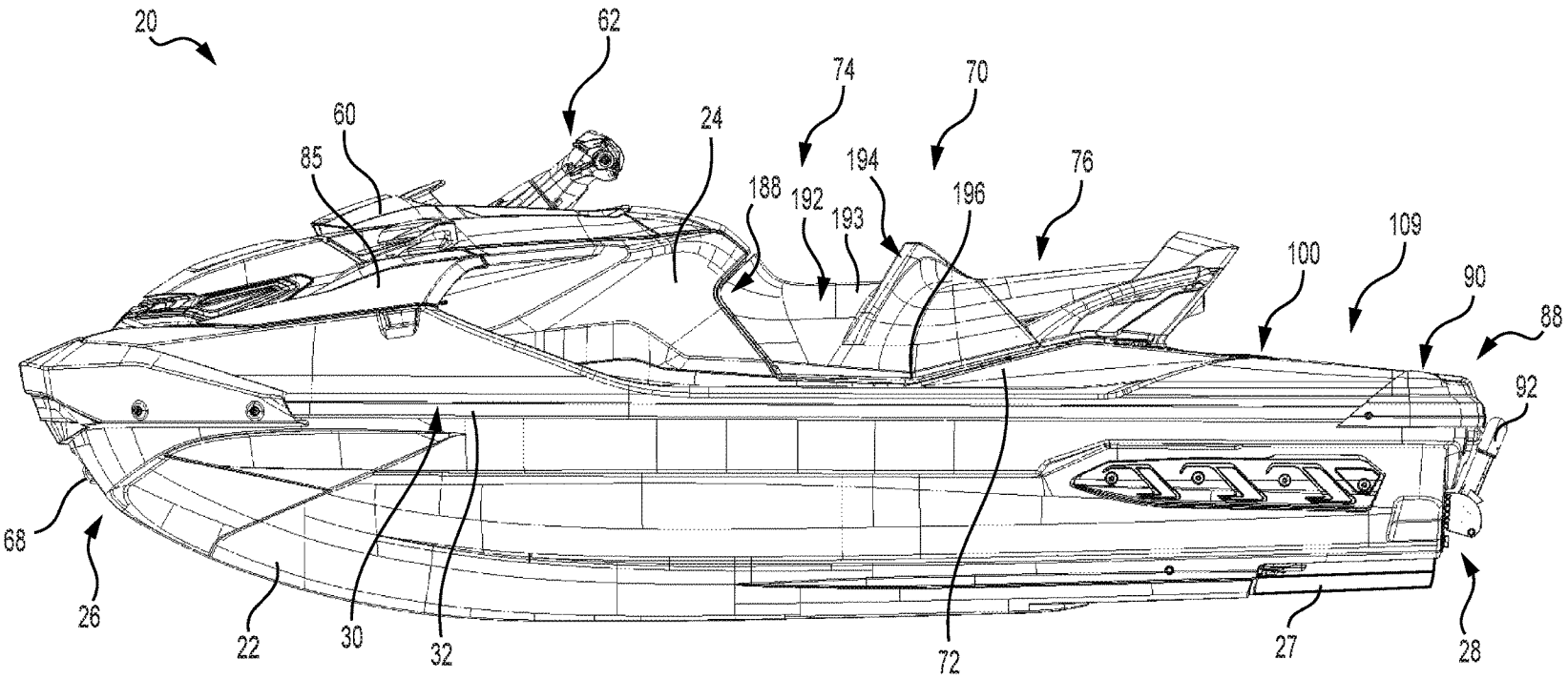
FIG. 2 is a left side elevation view of the personal watercraft of FIG. 1.
Figure 3:
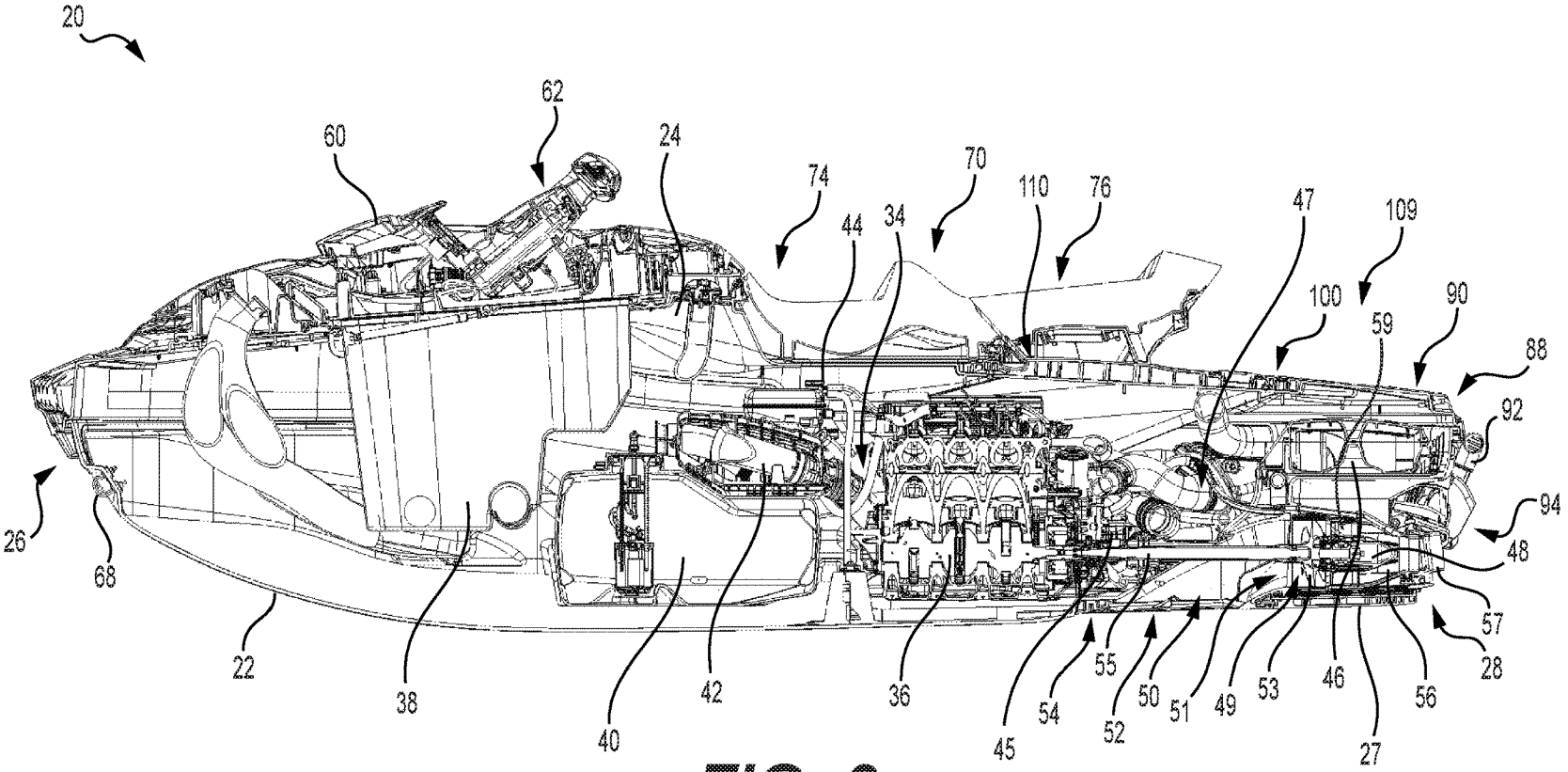
FIG. 3 is a longitudinal cross-sectional view taken from a left side of the personal watercraft of FIG. 1.

Referring to FIGS. 1 to 3, an implementation of a personal watercraft 20 is shown. The personal watercraft 20 has a hull 22 and a deck 24. The hull 22 and the deck 24 are made of fiberglass composite material. It is contemplated that other suitable materials could be used to make the hull 22 and the deck 24. The hull 22 buoyantly supports the watercraft 20 in the water. The hull 22 has a bow 26 and a stern 28. A longitudinal centerline 29 extends between the bow 26 and the stern 28 and splits the deck 24 into a left longitudinal side 31 and a right longitudinal side 33 (FIG. 1). For the purpose of the following description, the components that are qualified as "left" or "right" are positioned on the corresponding left longitudinal side 31 and right longitudinal side 33 of the deck 24, unless mentioned otherwise.

The deck 24 is designed to accommodate an operator and two passengers, collectively referred to as riders. It is contemplated that the deck 24 could be designed to accommodate just one passenger or more than two passengers. The hull 22 and the deck 24 are joined together at a seam 30 that joins the parts in a sealing relationship. The seam 30 comprises a bond line formed by an adhesive. Other known joining methods could be used to sealingly engage the parts together, including but not limited to thermal fusion, molding or fasteners such as rivets, bolts or screws. A bumper 32 generally covers the seam 30. The bumper 32 helps to prevent damage to the outer surface of the watercraft 20 when the watercraft 20 is docked, for example. The bumper 32 can extend around the bow 26 and the stern 28, as shown, or around any portion or the entire seam 30.

The space between the hull 22 and the deck 24 forms a volume commonly referred to as the motor compartment 34 (FIG. 3). The motor compartment 34 accommodates a motor 36, in the form of an internal combustion engine, as well as a storage bin 38, a fuel tank 40, an air box 42, an electrical system 44 (battery, electronic control unit, etc.), a resonator 46 and other elements required or desirable in the personal watercraft 20, such as a supercharger 45 and an intercooler 47. The motor 36 drives a water jet propulsion system 48 of the personal watercraft 20, although other types of propulsion systems are contemplated in other implementations.

The hull 22 defines part of an intake ramp 50 extending from an inlet 52 to a jet pump 49 of the jet propulsion system 48. The intake ramp 50 allows passage of water from underneath the hull 22, through the inlet 52 defined on the bottom 54 of the hull 22, and into the jet pump 49. The jet pump 49 is located in a formation in the hull 22, referred to as the tunnel 51. The tunnel 51 is defined at the front, sides and top by the hull 22 and is open at the transom 94. As can be seen in FIGS. 1 to 3, the bottom of the tunnel 51 is closed by a ride plate 27. The ride plate 27 creates a surface on which the personal watercraft 20 rides or planes at high speeds.

The jet pump 49 includes an impeller 53 and a stator 59. The impeller 53 is coupled to the motor 36 by one or more shafts 55, such as a driveshaft and an impeller shaft. The rotation of the impeller 53 pressurizes the water, which then moves over the stator 59 that is made of a plurality of fixed stator blades (not shown). The role of the stator blades is to decrease the rotational motion of the water so that almost all the energy given to the water is used for thrust, as opposed to swirling the water. Once the water leaves the jet pump 49, it goes through a venturi 56. Since the venturi's 56 exit diameter is smaller than its entrance diameter, the water is accelerated further, thereby providing more thrust. A steering nozzle 57 is pivotally attached to the venturi 56 so as to pivot about a vertical axis (not shown). The steering nozzle 57 could also be supported at the exit of the tunnel 51 in other ways without a direct connection to the venturi 56. Moreover, the steering nozzle 57 can be replaced by a rudder or other diverting mechanism disposed at the exit of the tunnel 51 to selectively direct the thrust generated by the water jet propulsion system 48 to effect turning.

The steering nozzle 57 is operatively connected to a helm assembly 62 preferably via a push-pull cable (not shown) such that when the helm assembly 62 is turned, the steering nozzle 57 pivots. This movement redirects the pressurized water coming from the venturi 56, so as to redirect the thrust and steer the personal watercraft 20 in the desired direction.

Still referring to FIGS. 1 to 3, towards the bow 26, the deck 24 has a hood 60 including the helm assembly 62 and an instrument cluster 64. A hinge (not shown) is attached between a forward portion of the hood 60 and the front of the deck 24 to allow the hood 60 to move to an open position to provide access to the storage bin 38. A latch (not shown) located at a rearward portion of the hood 60 locks the hood 60 into a closed position. When in the closed position, the hood 60 prevents water from entering the storage bin 38. Left and right rear view mirrors 66 are positioned on corresponding left and right sides of the hood 60 to allow the operator to see behind the watercraft 20. A hook 68 is located at the bow 26 of the hull 22. The hook 68 is used to attach the watercraft 20 to a dock when the watercraft 20 is not in use or to attach to a winch when loading the watercraft 20 on a trailer, for example.

Figure 8:
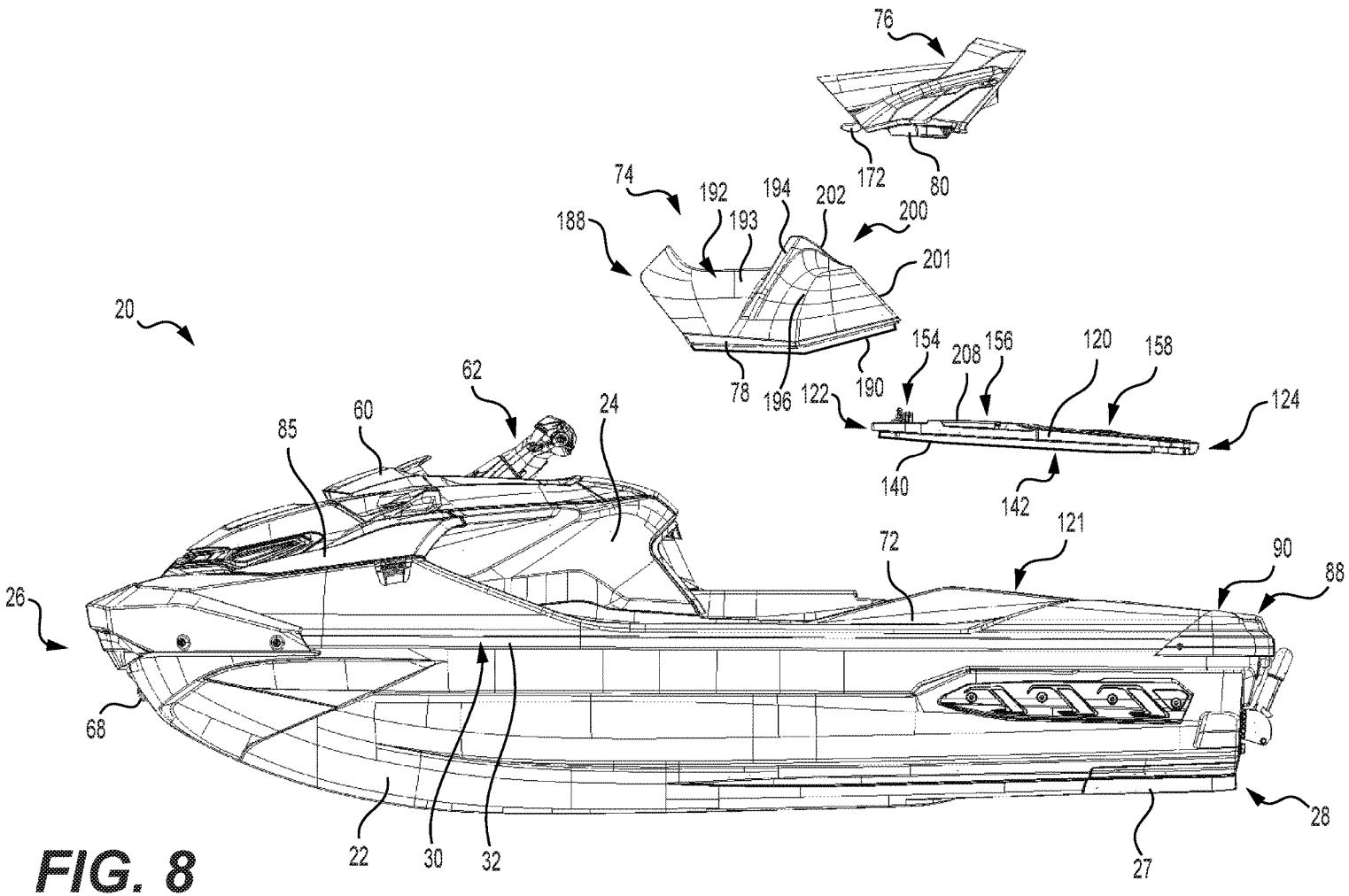
FIG. 8 is a partially exploded, left side elevation view of the personal watercraft of FIG. 1.
Figure 10:
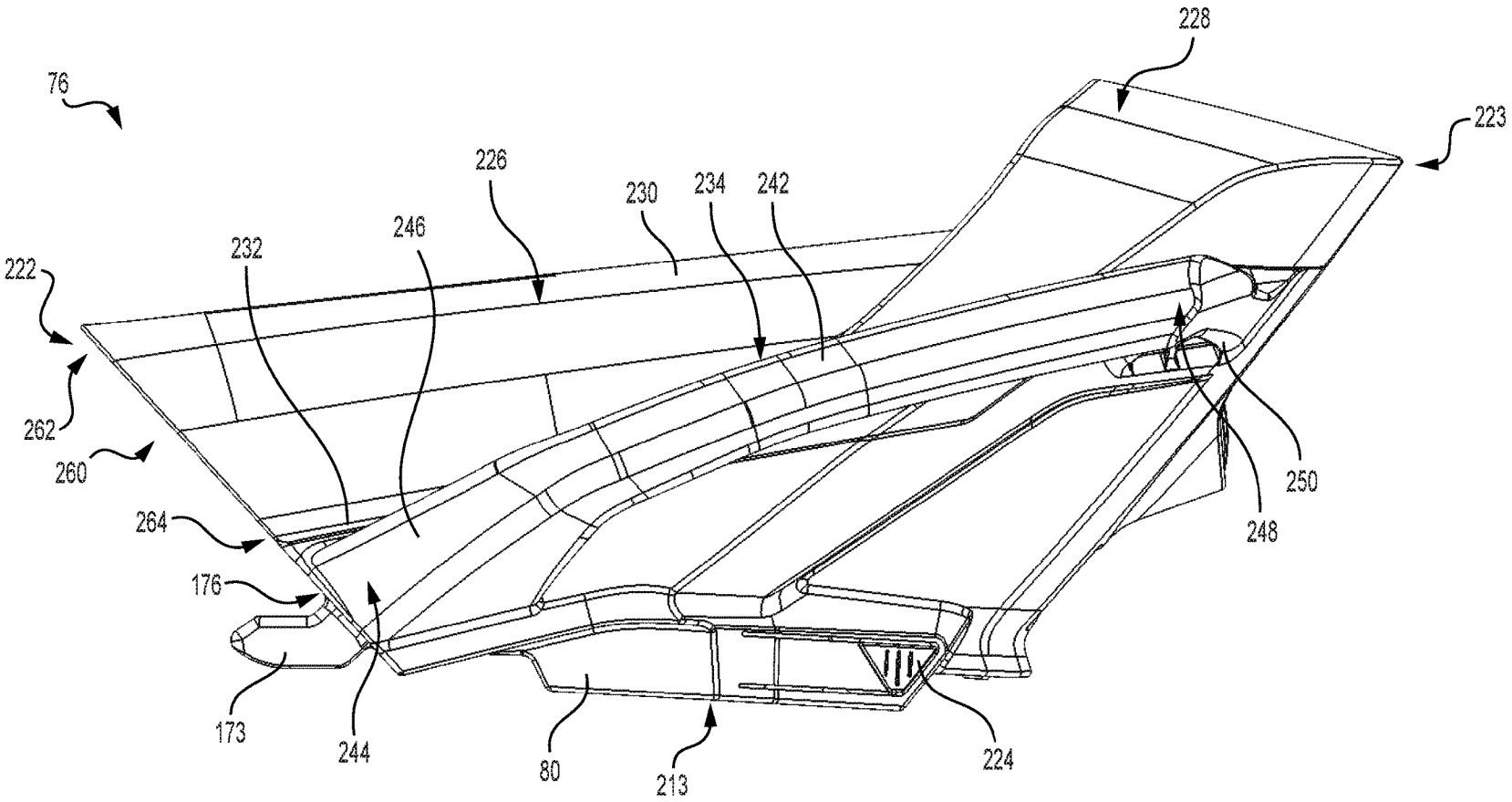
FIG. 10 is a left side elevation view of the rear seat portion of the personal watercraft of FIG. 1.

Still referring to FIGS. 1 to 3, the deck 24 has a centrally positioned straddle-type seat 70 supported on top of a pedestal 72 formed by the deck 24. Accordingly, the seat 70 and the pedestal 72 are aligned with the longitudinal centerline 29 of the deck 24. The seat 70 accommodates three riders in a straddling position. The seat 70 has a front seat portion 74 and rear seat portion 76 made as cushioned or padded units. The front seat portion 74 has a front base 78 and the rear seat portion 76 has a rear base 80 (FIG. 8). The front base 78 and the rear base 80 are interfitting and are removably connected to the deck 24. A cushion 193 is disposed on top of the front base 78 and a cushion 230 is disposed on top of the rear base 80 (FIG. 10). More detail regarding the front and rear seat portions 74, 76, the cushions 193, 230, the front and rear bases 78, 80 and their removable connection to the deck 24 will be provided below.

Figure 4:
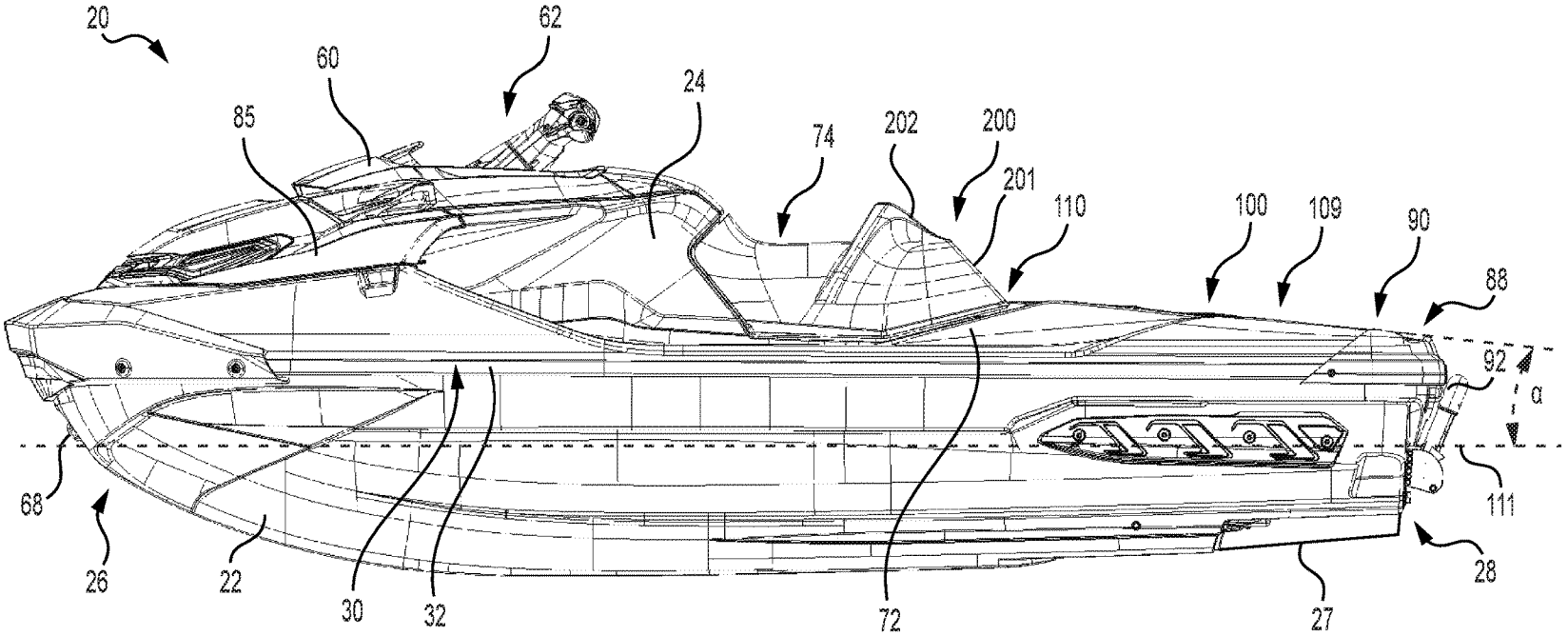
FIG. 4 is a left side elevation view of the personal watercraft of FIG. 1, with a rear seat portion removed.
Figure 5:
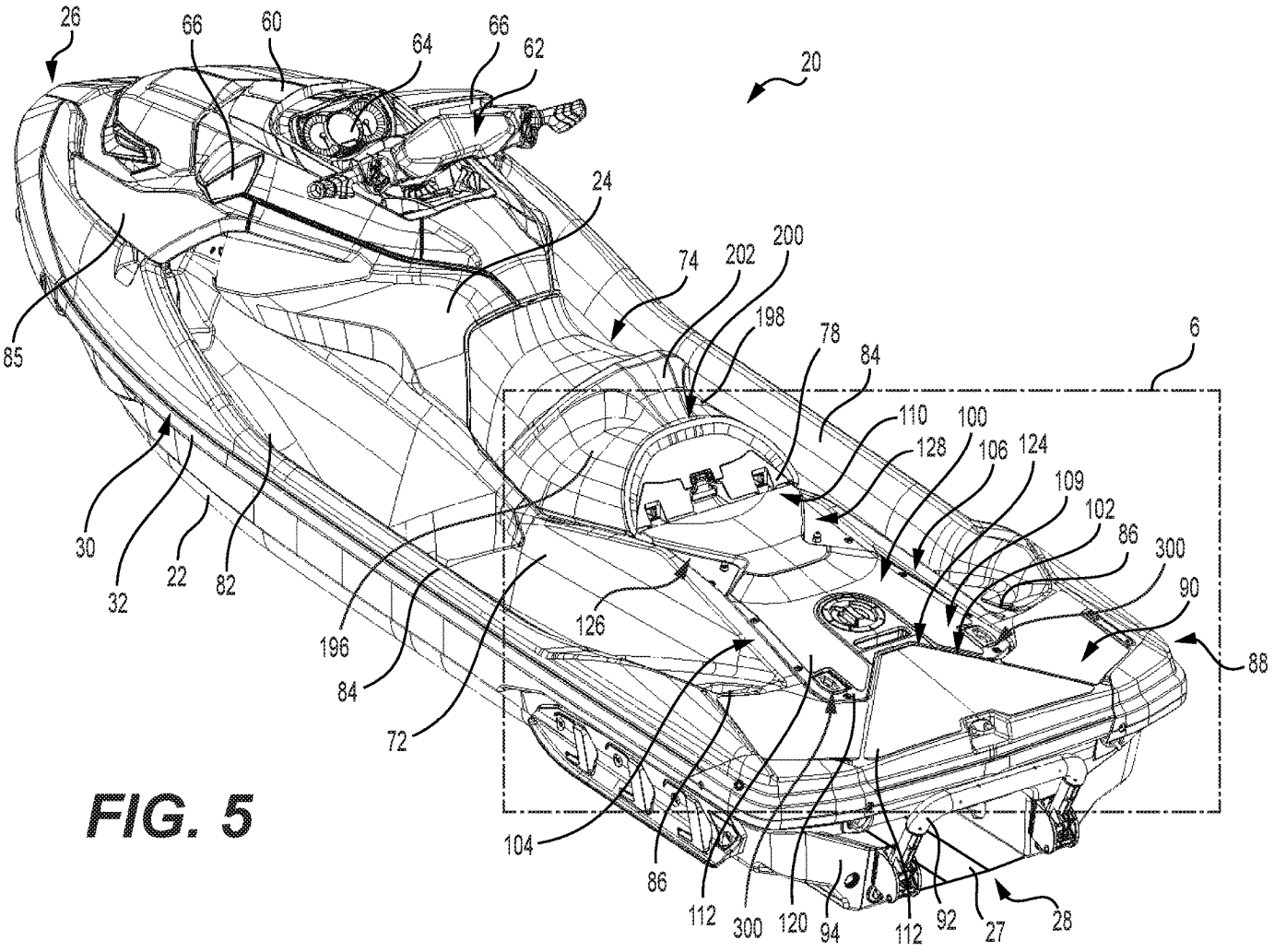
FIG. 5 is a top, left, rear side perspective view of the personal watercraft of FIG. 4.
Figure 6:
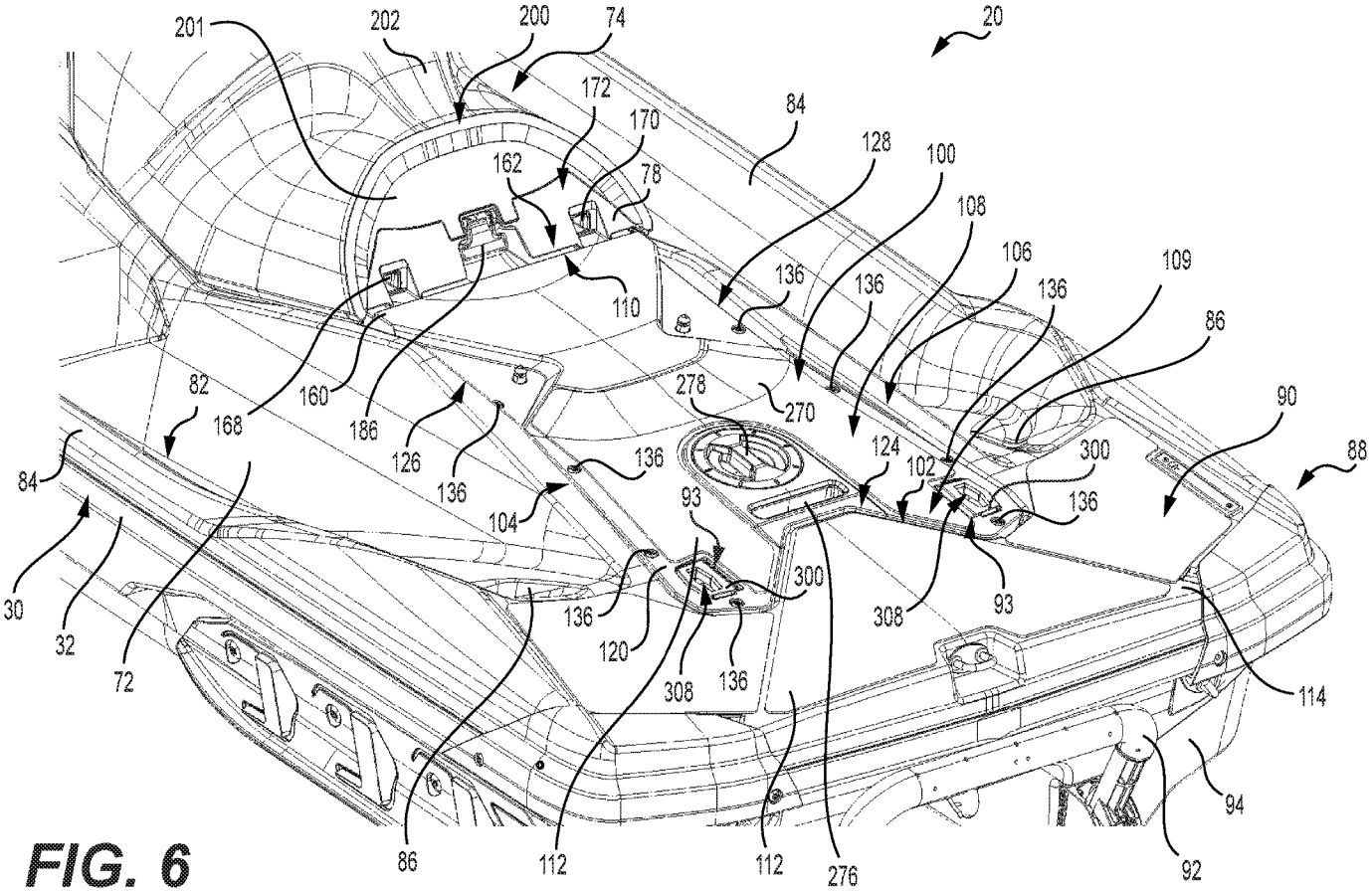
FIG. 6 is an enlarged view of the portion 6 of the personal watercraft of FIG. 1 shown in FIG. 5.

With additional reference to FIGS. 4 to 6, on the left and right sides of the pedestal 72, the deck 24 forms footwells 82 on either side of the pedestal 72 that provide support for the riders' feet. Along the footwells 82, the watercraft 20 has a pair of generally upwardly extending walls located on either side of the watercraft 20 known as gunwales or gunnels 84. The gunnels 84 help to prevent the entry of water in the footwells 82 of the watercraft 20, provide lateral support for the riders' feet, and also provide buoyancy when turning the watercraft 20, since the personal watercraft 20 can roll slightly when turning. Towards the bow 26, fairings 85 extend between the gunnels 84 and the hood 60 and further prevent the entry of water in the footwells 82. Towards the stern 28, the gunnels 84 extend inwardly to act as heel rests 86. A passenger riding the watercraft 20 and sitting on the seat 70 facing towards the rear may place his or her heels on the heel rests 86, thereby providing a more stable riding position when acting as spotter for a skier, tuber or the like. It is contemplated that the heel rests 86 could also be formed separately from the gunnels 84. Forward of a rear end 88 of the deck 24, the deck 24 includes a reboarding platform 90 allowing a rider to easily reboard the watercraft 20 from the water. The reboarding platform 90 extends longitudinally between a transom 94 of the personal watercraft 20 and the heel rests 86. The reboarding platform 90 extends laterally over a width of the deck 24, between the left side 31 and the right side 33 of the deck 24. As best seen in FIG. 5, a retractable ladder or reboarding step 92 is affixed to the transom 94 of the personal watercraft 20 to facilitate boarding of the personal watercraft 20 from the water onto the reboarding platform 90.

The personal watercraft 20 has a rear platform 100. The rear platform 100 is laterally centered on the deck 24, i.e. laterally centered along the longitudinal centerline 29 of the deck 24. The rear platform 100 extends forwards between footwells 82, from the reboarding platform 90. The rear platform 100 has a rear side 102, a left side 104 and a right side 106. Towards the rear side 102, the left and right sides 104, 106 of the rear platform 100 are adjacent to the reboarding platform 90 and to the heel rests 86. The rear side 102 of the rear platform 100 is adjacent to the reboarding platform 90. The left and right sides 104, 106 each extend forward, along an edge of pedestal 72, vertically higher than the left and right footwells 82. As can be seen in FIG. 6, the rear platform 100 has a top face 108. The top face 108 of the rear platform 100 has a portion which is generally coplanar with the reboarding platform 90. The term "coplanar" is to be understood in the sense that the top face 108 of the rear platform 100 and the reboarding platform 90 form a generally planar surface 109 at the rear of the deck 24, as shown in FIGS. 2 and 4. In other words, the generally planar surface 109 extends forward of the rear end 88 of the deck 24.

As can be seen in FIGS. 4 to 6 where the rear seat portion 76 has been removed from the top face 108 of the rear platform 100, the rear platform 100 has a front end 110. At the front end 110, the rear platform 100 is delimited by the front base 78 of the front seat portion 74. As can be seen in FIG. 3, the front end 110 of the rear platform 100 extends forward past the inlet 52 of the intake ramp 50.

To summarize, the rear platform 100 extends laterally between the left and right sides 104, 106 thereof, and longitudinally between the reboarding platform 90 and the front base 78 of the front seat portion 74. Thus, the generally planar surface 109, formed by the rear platform 100 and the reboarding platform 90, extends from the rear end 88 of the deck 24 to the front base 78 of the front seat portion 74.

Referring to FIG. 4, it can also be seen that the generally planar surface 109 formed by the rear platform 100 and the reboarding platform 90 extends upwardly and forwardly from the rear end 88 of the deck 24. The generally planar surface 109 is inclined such that an angle $\alpha$ formed between the generally planar surface 109 and a waterline 111 of the personal watercraft 20 is less than 30 degrees. In some implementations, the angle $\alpha$ is less than 15 degrees. The term "waterline" refers to the line where the water comes to on the hull 22 of the personal watercraft 20, when the personal watercraft 20 is unloaded, at rest and leveled.

Referring to FIGS. 1, 5 and 6, the rear platform 100 comprises a padding material 112 along the top face 108 of the rear platform 100 and a top face 114 (FIG. 6) of the reboarding platform 90. The padding material 112 is a foam mat having a texturized surface. Other types and configurations of padding material could be used. The padding material 112 may provide more comfort and traction to a rider boarding the watercraft 20 from the water and/or to a rider lying down on the rear platform 100.

Figure 7:
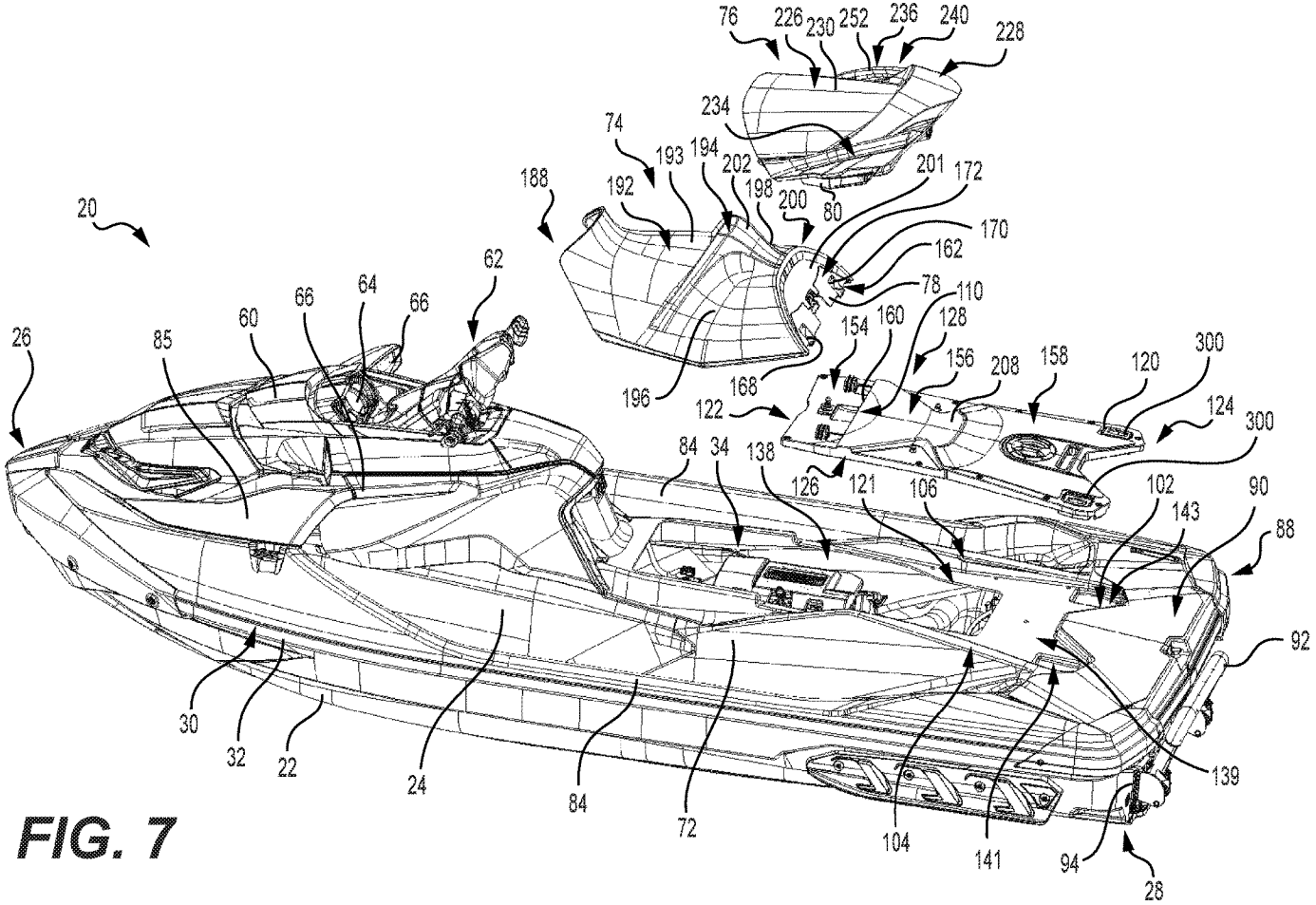
FIG. 7 is a partially exploded, top, left, rear side perspective view of the personal watercraft of FIG. 1.

Referring to FIGS. 5 to 9, the rear platform 100 includes a deck panel 120. The deck panel 120 connects to an upper central portion 121 of the deck 24 (FIGS. 7 and 8), forward of the reboarding platform 90. The upper central portion 121 of the deck 24 defines the upper portion of the pedestal 72. The deck panel 120 has a front side 122, a rear side 124, a left side 126 and a right side 128. As can be seen in FIGS. 6 and 7, the front side 122 of the deck panel 120 is forward of the front end 110 of the rear platform 100, as the front base 78 of the front seat portion 74 overlaps the front side 122 of the deck panel 120 when the front seat portion 74 is connected to the deck panel 120. The rear side 124 of the deck panel 120 is coincident with the rear side 102 of the rear platform 100. The deck panel 120 thus extends longitudinally between the reboarding platform 90 and the front seat portion 74. The left and right sides 126, 128 are adjacent to the left and right sides 104, 106 of the rear platform 100, respectively. The deck panel 120 thus extends laterally between the left and right sides 104, 106 of the rear platform 100.

Figure 9:
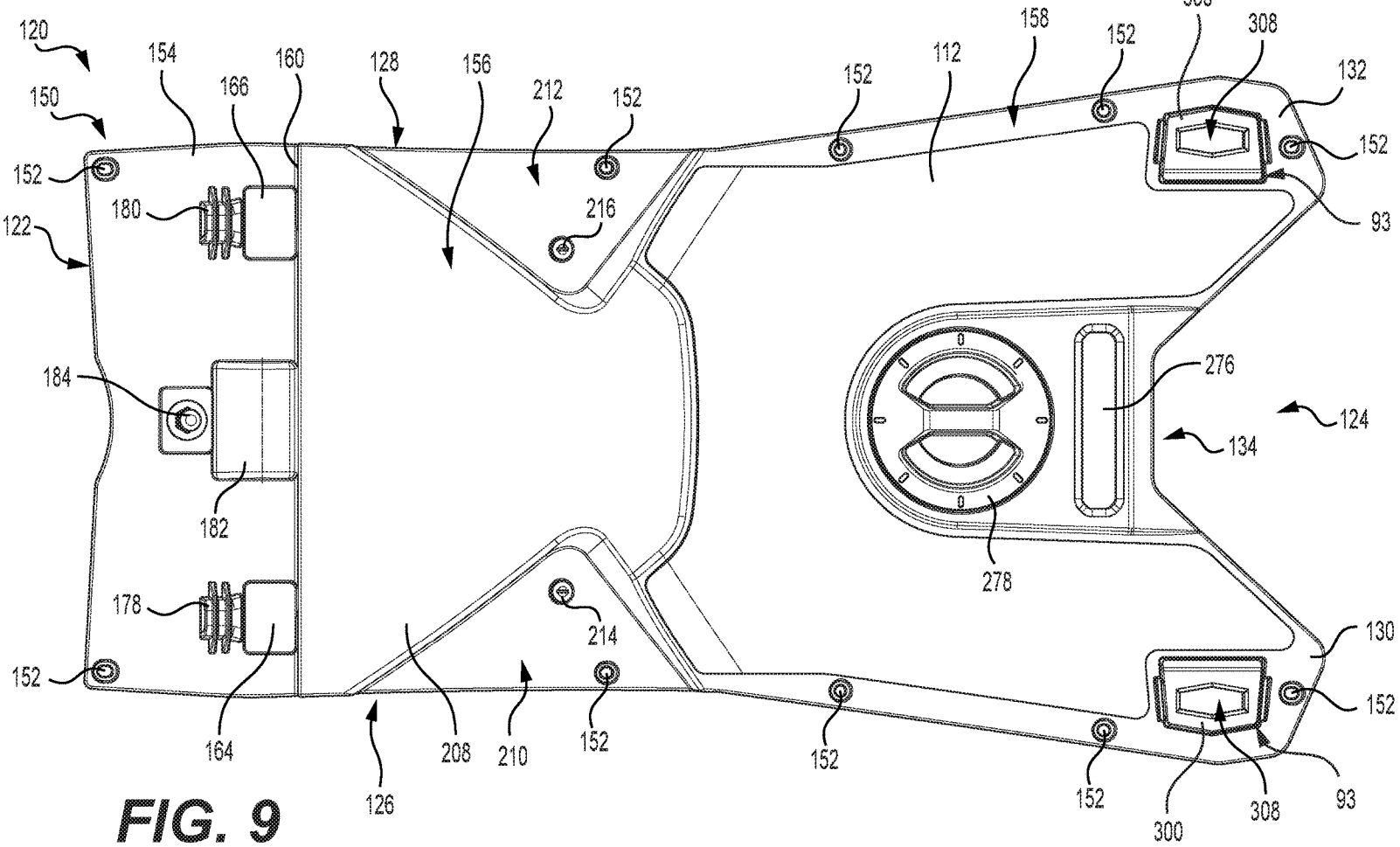
FIG. 9 is a top plan view of a deck panel of the personal watercraft of FIG. 1.

Referring to FIG. 9, the rear side 124 of the deck panel 120 has a left protrusion 130 and a right protrusion 132. An indent 134 is defined on the rear side 124 of the deck panel 120 between the left and right protrusions 130, 132. When the deck panel 120 is connected to the upper central portion 121 of the deck 24, the reboarding platform 90 extends forward in the indent 134 between the left and right protrusions 130, 132 (FIG. 6).

The deck panel 120 is connected to the upper central portion 121 of the deck 24 using ten fasteners 136 (only eight fasteners 136 are shown in FIG. 6). When the deck panel 120 is connected to the upper central portion 121 of the deck 24, the deck panel 120 partially covers an aperture 138 defined in the upper central portion 121 of the deck 24 (FIG. 7). A forward portion of the motor compartment 34 can be accessed via the portion of the aperture 138 that is not covered by the deck panel 120 when the front and rear seat portions 74, 76 are removed. To access the forward and a rearward portions of the motor compartment 34, the front and rear seat portions 74, 76 and the deck panel 120 are removed, as shown in FIGS. 7 and 8. As can be seen in FIG. 7, the deck panel 120 is received in a deck recess 139 defined between the reboarding platform 90 and the aperture 138. On the left and right sides of the indent 134, the deck recess 139 defines left and right anchor recesses 141, 143. The left and right anchor recesses 141, 143 are configured to receive bottom portions of corresponding left and right anchors fixtures 300 provided on the deck panel 120. The left and right anchors fixtures 300 will be described further below.

Referring to FIG. 8, a gasket 140 is connected to a bottom face 142 of the deck panel 120 to help prevent water infiltration into the engine compartment 34 when the deck panel 120 is connected to the upper central portion 121 of the deck 24. The gasket 140 is shaped and configured to seal a spacing between the deck panel 120 and the upper central portion 121 of the deck 24 when the deck panel 120 is connected thereto. In an alternative implementation, a gasket could be connected to the upper central portion 121 of the deck instead of being connected to the bottom face 142 of the deck panel 120.

It is contemplated that the deck panel 120 could be configured otherwise. For instance, in an alternative implementation where an aperture defined in the upper central portion of the deck would be smaller than the aperture 138, the deck panel 120 could be dimensioned so as to cover that aperture and not necessarily have, for example, the left and right sides adjacent to the left and right sides 104, 106 respectively of the rear platform 100. In an alternative implementation, the deck panel could also be formed integrally with the deck 24.

Referring to FIG. 9, the deck panel 120 has a top face 150. The deck panel 120 has ten bolt holes 152 extending between the top face 150 and the bottom face 142. Five bolt holes 152 are defined on both left and right sides 126, 128 respectively of the deck panel 120. The bolt holes 152 allow the deck panel 120 to be connected to the upper central portion 121 of the deck 24 using the fasteners 136 mentioned above. Other configurations of bolt holes 152 and/or fasteners 136 could be used. The top face 150 of the deck panel 120 has a front seat area 154, a rear seat area 156 and a platform area 158. Each one of the front seat area 154, the front seat portion 74, the rear seat area 156, the rear seat portion 76 and the platform area 158 will now be described in more detail.

Referring to FIGS. 6 to 9, the front seat area 154 and the connection of the front seat portion 74 thereto will now be described. The front seat area 154 extends between the front side 122, the left side 126 and the right side 128 of the deck panel 120. A wall 160 extends between the front seat area 154 and the rear seat area 156, the wall 160 extending from the left side 126 to the right side 128. The wall 160 delimits the front seat area 154 from the rear seat area 156 as the front seat area 154 extends slightly below the rear seat area 156 (FIGS. 6 to 8). When the front seat portion 74 is connected to the deck panel 120, the front base 78 of the front seat portion 74 overlaps the deck panel 120 such that the front base 78 overlaps the front seat area 154. A rear end 162 (FIGS. 6 and 7) of the front base 78 is received on the front seat area 154 and the rear end 162 is adjacent to the wall 160.

Figure 11:
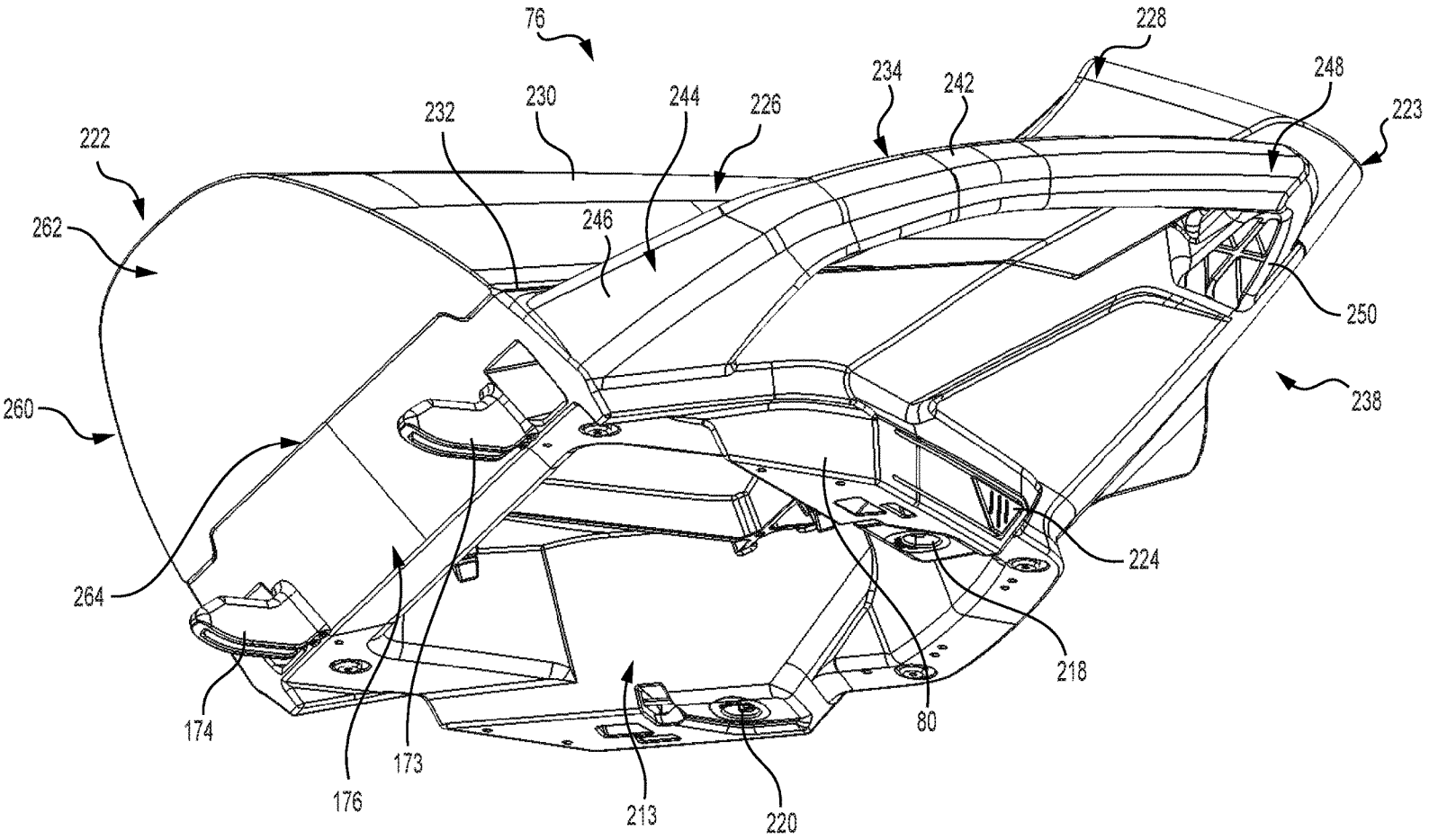
FIG. 11 is a bottom, left, front side perspective view of the rear seat portion of FIG. 10.

Still referring to FIGS. 6 to 9, the front seat area 154 of the deck panel 120 defines left and right tongue recesses 164, 166. A rear of each one of the left and right tongue recesses 164, 166 is defined by the wall 160. The left and right tongue recesses 164, 166 align with left and right tongue recesses 168, 170 defined in a rear face 172 of the front base 78. The left tongue recesses 164, 168 and the right tongue recesses 166, 170 are configured to receive corresponding left and right tongues 173, 174 extending from a front face 176 of the rear base 80 (FIG. 11). The front base 78 and the rear base 80 are thus interfitting so as to form the seat 70 of the personal watercraft 20, as mentioned above. Forward of each left and right tongue recesses 164, 166, left and right hooks 178, 180 extend upwardly from the front seat area 154. The left and right hooks 178, 180 are configured to receive the corresponding left and right tongues 173, 174. The tongue recesses 164, 166 provide clearance to pivot the tongues 173, 174 in the hooks 178, 180 when the rear seat portion 76 is connected to or removed from the deck 24. Other configurations of the tongue recesses 164, 166, 168, 170, tongues 173, 174 and hooks 178, 180 could be used so that the front base 78 and the rear base 80 are interfitting.

Referring to FIG. 9, the front seat area 154 further defines a latch recess 182 extending between the left and right tongue recesses 164, 166. The latch recess 182 is positioned along the longitudinal centerline 29 of the deck 24. A rear of the latch recess 182 is defined by the wall 160. Forward of the latch recess 182, a peg 184 extends upwardly from the front seat area 154. The peg 184 is also positioned along the longitudinal centerline 29 of the deck 24. The front base 78 has a latch (not shown) provided on the bottom face thereof. The latch is configured to connect to the peg 184. A lever 186 (FIG. 6), which is part of the latch, is accessed from the rear face 172 of the front base 78. When the lever 186 is actuated, the lever 186 releases the latch. The latch recess 182 allows for a user to grasp the lever 186 when the front base 78 is connected to the top face 150 of the deck panel 120. It is contemplated that other known seat connectors for removably connecting the front seat portion 74 to the deck 24 could be used. For example, a latch could be provided on the top face 150 of the deck panel 120 and a peg could extend downwardly from the bottom face of the front base, the peg and latch being configured to connect the front seat portion 74 to the deck 24.

An illustrative scenario describing how the front base 78 is connected to the front seat area 154 of the top face 150 of the deck panel 120 is now provided. In this scenario, the rear seat portion 76 has initially been removed from the top face 150 of the deck panel 120, as shown in FIGS. 5 and 6 for example. In a situation where the front seat portion 74 is to be removed from the deck 24 and from the top face 150 of the deck panel 120, a user first actuates the lever 186 and causes the latch to be released from the peg 184. Then, the user pulls the front seat portion 74 upwardly and tilts the front seat portion 74 forwardly in order to remove the front seat portion 74 from the deck 24. In a situation where the front seat portion 74 is to be connected to deck 24 and to the top face 150 of the deck panel 120, the front seat portion 74 is first lowered toward the deck 24 and tilted forward so that a front end 188 (FIGS. 2, 7 and 8) of the front seat portion 74 connects to the deck 24. The front end 188 of the front seat portion 74 is secured to the deck 24 through a tongue and hook connection (not shown). The tongue extends forwardly from the front end 188 and the hook is provided on the deck 24. Then, when the latch is positioned above the peg 184 and when the left and right recesses defined on the bottom face of the front base 78 are aligned with the left and right hooks 178, 180 of the front seat area 154, the front seat portion 74 is pushed downwardly until the latch connects to the peg 184.

Referring to FIGS. 2, 5, 7 and 8, the front seat portion 74 will now be described in more detail. When the front seat portion 74 is connected to the pedestal 72 of the deck 24, the front seat portion 74 covers partially the aperture 138 defined in the upper central portion 121 of the deck 24. A gasket 190 is connected to the bottom face of the front base 78 to help prevent entry of water into the engine compartment 34. The gasket 190 is sized and configured to seal a spacing between the front base 78 and the upper central portion 121 of the deck 24 when the front base 78 is connected thereto. In an alternative implementation, a gasket could be connected to the upper central portion 121 of the deck 24, the gasket surrounding the aperture 138 defined therein. The gasket could be configured to seal a spacing between the front base 78 and the upper central portion 121 of the deck 24, and a spacing between the bottom face 142 of the deck panel 120 and the upper central portion 121 of the deck 24.

Still referring to FIGS. 2, 5, 7 and 8, the front seat portion 74 has a driver seat portion 192 toward the front end 188 of the front seat portion 74. The driver seat portion 192 is configured to accommodate an operator of the personal watercraft 20 operating the vessel. The front seat portion 74 defines a back rest 194 extending upwardly and rearwardly from the driver seat portion 192. The driver seat portion 192 and the back rest 194 are made of the cushion 193, the cushion 193 being disposed on top of the front base 78 as mentioned above. The front seat portion 74 further defines left and right concave portions 196, 198 rearward of the driver seat portion 192. The left and right concave portions 196, 198 define knee rests for receiving knees of a rider of the personal watercraft 20 sitting on the rear seat portion 76 and facing forward. The left and right concave portions 196, 198 are separated by a rear surface 200 of the front seat portion 74. The rear surface 200 is also made of the cushion 193. The rear surface 200 extends upwardly of the left and right concave portions 196, 198 and along the longitudinal centerline 29 of the deck 24. The rear surface 200 extends upwardly of the rear face 172 of the front base 78. The rear surface 200 has a lower portion 201 which is generally coplanar with the rear face 172 of the front base 78. The rear surface 200 also has an upper portion 202 that is inclined such that the upper portion 202 is positioned forward relative to the lower portion 201 of the rear surface 200. As such, the rear surface 200 overlaps the front seat area 154 of the deck panel 120 (FIG. 7). The upper portion 202 of the rear surface 200 is laterally centered on the front seat portion 74. The upper portion 202 of the rear surface 200 separates the left and right concave portions 196, 198. When the rear seat portion 76 is removed, such as in FIGS. 4 to 6, the rear surface 200 is configured to accommodate a rider lying down on the rear platform 100. For example, if the rider is lying down on his back on the rear platform 100, the neck of the rider may rest on the lower portion 201 of the rear surface 200 and the head of the rider may rest on the upper portion 202 of the rear surface 200.

Referring to FIGS. 7 to 11, the rear seat area 156 of the top face 150 of the deck panel 120 and the connection of the rear seat portion 78 thereto will now be described. The rear seat area 156 extends between the left and right sides 126, 128 of the deck panel 120, the wall 160 and the platform area 158. The rear seat area 156 has a central area 208 extending above the front seat area 154 and slightly above the platform area 158 (FIGS. 7 and 8). On either side of the central area 208, the rear seat area 156 defines left and right recessed areas 210, 212 respectively. The central area 208 may assist in aligning the rear seat portion 76 onto the rear seat area 156 during connection thereto since a bottom face 213 (FIG. 11) of the rear base 80 of the rear seat portion 76 has a corresponding hollow region. Each one of the left and right recessed areas 210, 212 includes a corresponding left and right peg 214, 216 respectively. The left and right pegs 214, 216 are configured to connect to corresponding left and right downwardly facing latches 218, 220 provided on the bottom face 213 of the rear base 80 of the rear seat portion 76 (FIG. 11). The rear base 80 also includes a left button 224 and a right button (only the left button 224 is shown) that are part of the corresponding left and right latches 218, 220. When pressed, each one of the left button 224 and the right button releases the corresponding left and right latch 218, 220 respectively from the corresponding left and right pegs 214, 216.

An illustrative scenario describing how the rear base 80 is connected to the rear seat area 156 of the top face 150 of the deck panel 120 is now provided. In this scenario, the rear seat portion 76 is initially connected to the rear seat area 156, as in FIGS. 1 and 2 for example. In a situation where the rear seat portion 76 is to be removed from the rear seat area 156, a user first presses the left button 224 and the right button for releasing the corresponding latches 218, 220 from the corresponding pegs 214, 216. Then, the user pulls the rear seat portion 76 upwardly and tilts the rear seat portion 76 forwardly in order to remove the rear seat portion 76 from the rear seat area 156 and from the front base 78 such that the left and right tongues 173, 174 extending from the front face 176 of the rear base 80 (FIG. 11) are disengaged from the corresponding left and right recesses 168, 170 defined in the rear face 172 of the front base 78 and from the corresponding left and right hooks 178, 180 provided on the front seat area 154. In a situation where the rear seat portion 76 is to be connected to the rear seat area 156, the rear seat portion 76 is first lowered toward the rear seat area 156 and the rear seat portion 76 is tilted forward such that the left and right tongues 173, 174 are received in the corresponding left and right recesses 168, 170 and the left and right hooks 178, 180, and such that the left and right latches 218, 220 are aligned with the corresponding pegs 214, 216. Then, the rear seat portion 76 is pushed downwardly until the latches 218, 220 connect to the pegs 214, 216. When the rear seat portion 76 is connected to the rear seat area 156, the front seat portion 74 cannot be removed since the lever 186 is covered by the front face 176 of the rear base 80.

It is contemplated that seat connectors other than the peg and latch combination described above could be used for connecting the rear seat portion 76 to the rear seat area 156. In an alternative implementation, more than two pegs and latches could be used. In an alternative implementation, the rear base 80 has left and right downwardly extending pegs and the rear seat area 156 has corresponding upwardly facing latches.

Referring to FIGS. 10 and 11, the rear seat portion 76 will now be described in more detail. The rear seat portion 76 has a front end 222 and a rear end 223. A passenger seat portion 226 extends between the front end 222 and the rear end 223. The passenger seat portion 226 is configured to accommodate two passengers on the personal watercraft 20. The rear seat portion 76 defines a back rest 228 extending upwardly and rearwardly from the passenger seat portion 226, toward the rear end 223. The passenger seat portion 226 and the back rest 228 are made of the cushion 230, the cushion 230 being disposed on top of the rear base 80 as mentioned above. As can be seen in FIGS. 10 and 11, a majority of the left and right lateral sides 238, 240 (FIG. 1) of the rear base 80 are not covered by the cushion 230 as a lower edge 232 of the cushion 230 extends above the rear base 80. In other words, the left and right lateral sides 238, 240 of the rear base 80 remain exposed.

Referring to FIGS. 7, 10 and 11, left and right grab handles 234, 236 respectively are connected to the corresponding left and right lateral sides 238, 240 of the rear base 80. The left and right grab handles 234, 236 are configured to provide a handle onto which the one or more passengers of the personal watercraft 20 may hold. The left grab handle 234 extends from the left lateral side 238 of the rear base 80, and the right grab handle 236 extends from the right lateral side 240 of the rear base 80. As such, when the rear seat portion 76 is removed from the rear seat area 156, the left and right grab handles 234, 236 are removed from the deck 24 as well. The left and right grab handles 234, 236 are integral with the rear base 80. It is contemplated that the left and right grab handles 234, 236 could be connected to the rear base 80 otherwise, with fasteners for example.

Still referring to FIGS. 7, 10 and 11, the left grab handle 234 will now be described in more detail. The left grab handle 234 has a handle portion 242. A front 244 of the handle portion 242 is connected to the rear base 80 by a front connecting arm 246. A rear 248 of the handle portion 242 is connected to the rear base 80 by a rear connecting arm 250. As can be seen in FIG. 10, the rear connecting arm 250 connects to the rear base 80 upwardly and rearwardly relative to the front connecting arm 246. The front connecting arm 246 connects to the rear base 80 rearward of the front face 176 thereof and the rear connecting arm 250 connects to the rear base 80 forward of the rear end 223 of the rear seat portion 76. The front connecting arm 246 of the left grab handle 234 is disposed forward of the left latch 218 and the rear connecting arm 250 of the left grab handle 234 is disposed rearward of the left latch 218. Both the front and rear connecting arms 246, 250 respectively are positioned below the lower edge 232 of the cushion 230.

The right grab handle 236 is connected to the right lateral side 240 of the rear base 80 in a fashion similar to the left grab handle 234. Accordingly, the right grab handle 236 has a handle portion 252 (FIG. 7). A front (not shown) of the handle portion 252 is connected to the rear base 80 by a front connecting arm (not shown). A rear (not shown) of the handle portion 252 is connected to the rear base 80 by a rear connecting arm (not shown). As for the left grab handle 234, the front connecting arm of the right grab handle 236 is disposed forward of the right latch 220, and the rear connecting arm of the right grab handle 236 is disposed rearward of the right latch 220.

Still referring to FIGS. 7, 10 and 11, the rear seat portion 76 also has a front surface 260 extending upwardly between the front face 176 of the rear base 80 and the front end 222 of the rear seat portion 76. The front surface 260 is inclined such that an upper portion 262 of the front surface 260 is positioned forward relative to a lower portion 264 of the front surface 260. As such, when the front seat portion 74 is connected to the front seat area 154 and when the rear seat portion 76 is connected to the rear seat area 156, the front surface 260 of the rear seat portion 76 is adjacent to the rear surface 200 of the front seat portion 74.

It is contemplated that when the rear seat portion 76 is removed from the rear seat area 156 as described above, the rear seat portion 76 can be placed inside the storage bin 38. Once a rider removes the rear seat portion 76 from the rear seat area 156 as described above, the rider then unlocks the latch of the hood 60, pivots the hood 60 into the open position, inserts the rear seat portion 76 into the storage bin 38, pivots the hood 60 in the closed position and finally locks the latch of the hood 60. The configuration of the seat 70 of the personal watercraft 20 can thus be adjusted by a rider without using tools and while being on the water. Alternatively, the rear seat portion 76 could be removed and left at the dock.

Figure 12:
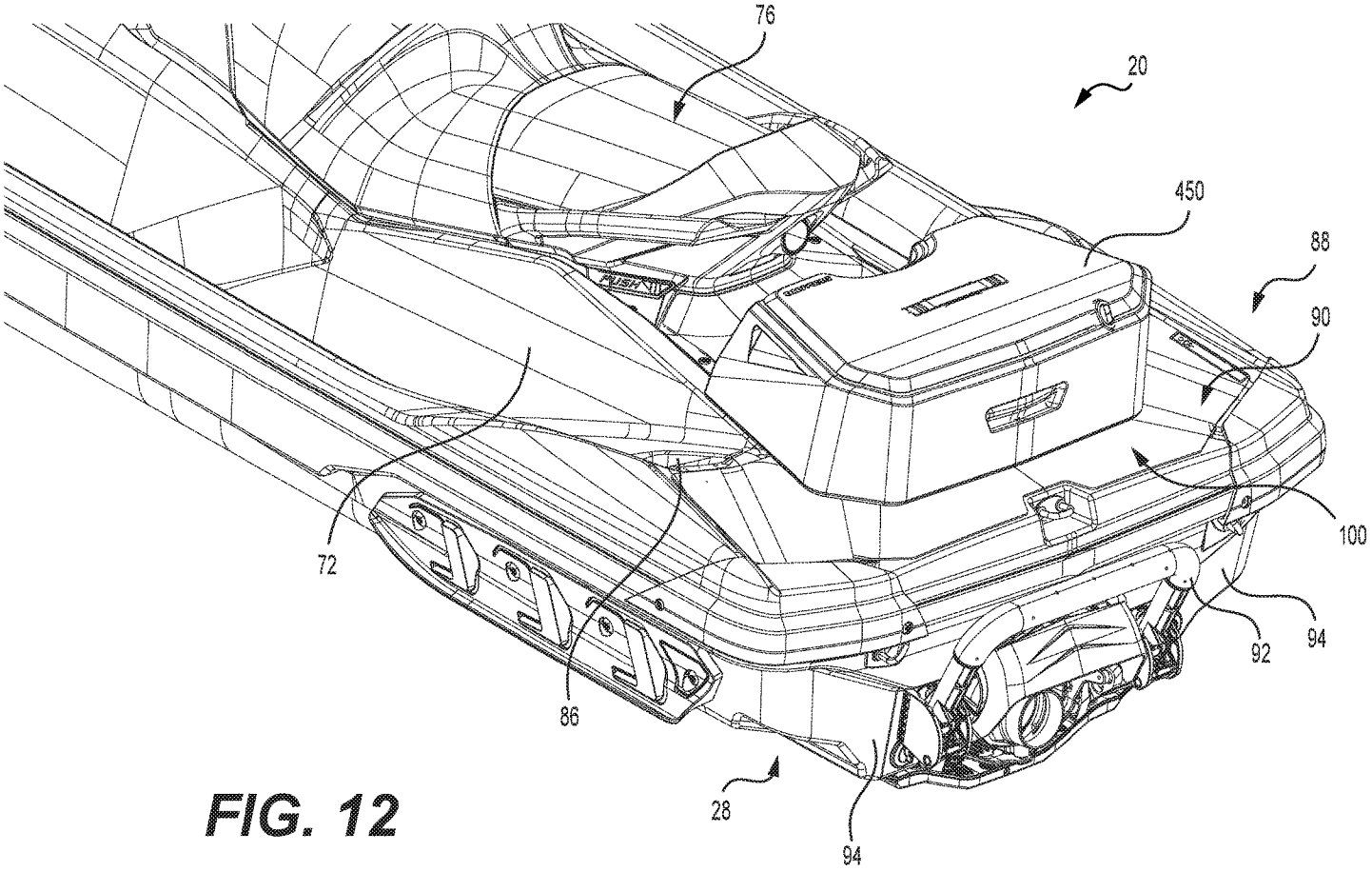
FIG. 12 is a rear, left side perspective view of the personal watercraft of FIG. 1, with an accessory container connected to the rear platform of the personal watercraft.
Figure 13:
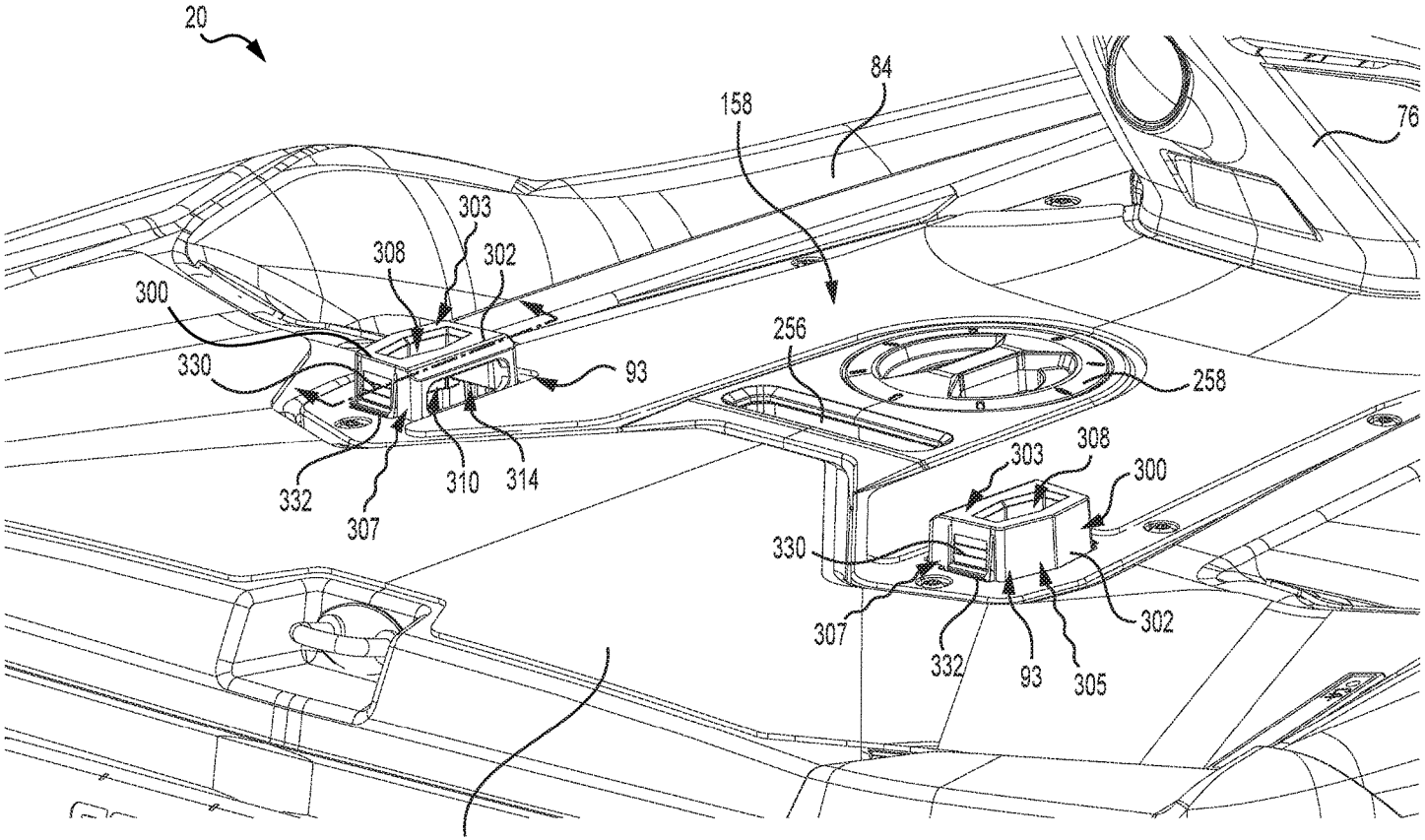
FIG. 13 is a top, right, rear side perspective view of the personal watercraft of FIG. 1, with two retractable anchor fixtures in an extended position.

Referring to FIGS. 6 to 9, the platform area 158 will now be described in more detail. The platform area 158 extends between the rear seat area 156 and the rear, left and right sides 124, 126, 128 respectively of the deck panel 120. As can be seen in FIG. 6, the platform area 158 has an inclined portion 270 adjacent to the rear seat area 156. At the front extremity of the inclined portion 270, the platform area 158 is leveled with the central area 208 of the rear seat area 156. The inclined portion 270 smooths down the difference between the level of the rear seat area 156 and the rear of the platform area 158. Padding material 112, described above with respect to the reboarding platform 90, is also connected to the top face 150 of the deck panel 120 over a portion of the platform area 158. On the left and right protrusions 130, 132 of the deck panel 120, the platform area 158 has the left and right anchor receiving recesses 99, with a bottom of the receiving recess 99 being defined by the anchor recess 141 or 143. The recesses 99 define opening apertures 93. This portion of the deck panel 120 (defining the receiving recesses 99) is located within the anchor recesses 141, 143. The left and right anchor recesses 99 are configured to receive retractable anchor fixtures 300 to fix a vehicle accessory to the deck panel 120. The fixtures 300 are movable through the apertures 93. FIG. 12 illustrates, for example, an accessory container 450 connected to the platform area 158. The vehicle accessory could also including but not limited to a cargo box, a cooler, and a fuel tank. The recesses 99 and the retractable anchor fixtures 300 will be described in more detail below.

Forward of the indent 134, the platform area 158 also defines a handhold 276. A rider may grasp the handhold 276 to facilitate boarding of the watercraft 20 from the water onto the reboarding platform 90. Forward of the handhold 276, the deck panel 120 includes a cap 278. The cap 278 can be removed and allow for a tow mast (not shown) to be placed in a hole (not shown) defined in the deck 24. The tow mast is a separate part that can be placed inside the storage bin 38, and placed in the hole of the deck 24 when needed. For instance, the tow mast can be used when towing a skier, a tuber or the like. It is also contemplated that other accessories, such as a fishing seat having a post extending below the seat, could be placed in the hole of the deck 24 when needed.

In an implementation, the rear platform 100 is configured to provide flexibility, thanks to the configurable seat 70, and convenience, thanks to generally planar surface 109 of the rear platform 100 and the reboarding platform 90, to an operator of the personal watercraft 20. Different examples of the use of the seat 70 and of the rear platform 100 will now be briefly described.

When the operator desires to carry one or more passengers, the rear seat portion 76 is connected to the rear seat area 156 and the one or more passengers can sit on the rear seat portion 76. At the same time, the rear platform 100 provides room for fixing items, such as a cooler, thereto using at least one of the anchors fixtures 300 and the hole of the deck 24.

When the operator desires to carry one or more large or bulky items, such as a cargo box, a cooler or a fuel tank, the operator may remove the rear seat portion 76 from the rear seat area 156, store the rear seat portion 76 inside the storage bin 38, and fix the one or more items to the rear platform 100 using at least one of the anchor fixtures 300, as will be described below, and the hole of the deck 24.

When the personal watercraft 20 is stopped, a rider may remove the rear seat portion 76 from the rear seat area 156, store the rear seat portion 76 inside the storage bin 38 or one of the footwells 82 and use the rear platform 100 as a sunbathing platform. The rider may thus lie down on the rear platform 100 and rest his/her head and neck on the rear surface 200 of the front seat portion 74.

In an implementation, the rear platform 100 is configured for conducting search and rescue operations. In such an implementation, the platform area 158 could include a floating mattress connected to the top face 150 of the deck panel 120. Rescue equipment, such as a first aid kit and an oxygen bottle, could be anchored to the left and right anchor fixtures 272, 274.

During search and rescue operations, the personal watercraft 20 may provide flexibility, thanks to the configurable seat 70, and convenience, thanks to the rear platform 100. For instance, a rescuer may drive the personal watercraft 20 to a person to rescue. The rescuer may help the person to board the watercraft 20 by pulling the person onto the generally planar surface 109 formed by the rear platform 100 and the reboarding platform 90. If the person is capable, the person may sit on the passenger seat portion 226 while the rescuer drives the personal watercraft 20. If the person is incapable to sit on the passenger seat portion 226, the rescuer may remove the rear seat portion 76 from the rear seat area 156 and store the rear seat portion 76 inside the storage bin 38 or in one of the footwells 82, allowing the person to lie down on the rear platform 100 and rest his/her head and neck on the rear surface 200 while the rescuer drives the personal watercraft 20.

The personal watercraft 20 has other features and components which would be readily recognized by one of ordinary skill in the art, further explanation and description of these components will not be provided herein.

The retractable anchor fixtures 300 will now be described in more detail in reference to FIGS. 6, 7 and 12 through 18, wherein two retractable anchor fixtures 300 for attaching the vehicle accessory to the personal watercraft 20 are provided rearward of the rear seat area 156 in the rear platform 100. The vehicle accessory is described herebelow with respect to the accessory container 450, shown connected to the watercraft 20 in FIG. 12, but can be various items as mentioned above.

The two retractable anchor fixtures 300 are provided in the rear platform 100 of the personal watercraft 20. The fixtures 300 are an oppositely facing pair, disposed on opposite sides of the longitudinal centerline 29. Each fixture 300 is disposed in one of the two recesses 99 defined in the rear platform 100. It is contemplated that the watercraft 20 could provide more or less retractable anchor fixtures 300, depending on the implementation. It also contemplated that the fixtures 300 could be oriented in directions other than those forming facing pairs. In some cases, the fixtures 300 could be multiple pairs.

Each fixture 300 is movable between two positions: a retracted position, illustrated in FIGS. 1 to 6, and an extended position, illustrated in FIGS. 13, 14, 17 and 18. In the retracted position, a top of the fixture 300 is generally aligned with the surrounding rear platform 100. In the illustrated embodiment, the depth of the recess 99 is the same as an overall height of the fixture 300 and thus the top of the fixture 300 is flush with the surrounding surfaces when the fixture 300 is resting on the bottom of the recess 99 (specifically, resting on the recess 141). It is contemplated that the top of the fixtures 300 could be situated below the platform 100 while remaining generally aligned with the surrounding platform 100. It is also contemplated that, in some implementations, a portion of the fixture 300 could extend slightly above the surrounding surfaces in the retracted position while remaining generally aligned with the surrounding platform 100. It is also contemplated that, in the retracted position, part of the top of the fixture 300 could be situated slightly below the platform 100 and that another part of the top of the fixture 300 could be situated slightly above the platform 100 while remaining generally aligned with the surrounding platform 100. In the extended position, a majority of the anchor fixture 300 is above the platform 100 and is accessible to be used to anchor the container 450.

Each recess 99 for receiving the retractable anchor fixture 300 defines the opening aperture 93 with a recess edge 95. In some vehicles, it is further contemplated that the fixtures 300 could be disposed to move through the aperture 93 without the aperture 93 being defined by the recess 99. It is further contemplated that the recess 99 and/or apertures 93 could be defined by a surface other than the rear platform 100.

Figure 15B:
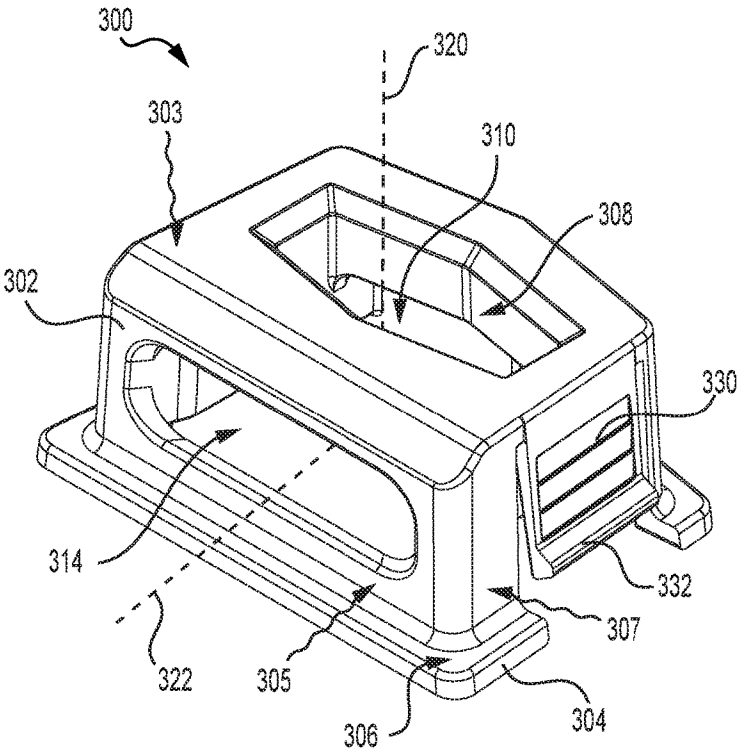
FIG. 15B is a top, right, front side perspective view of the left anchor fixture of FIG. 15A.
Figure 15A:
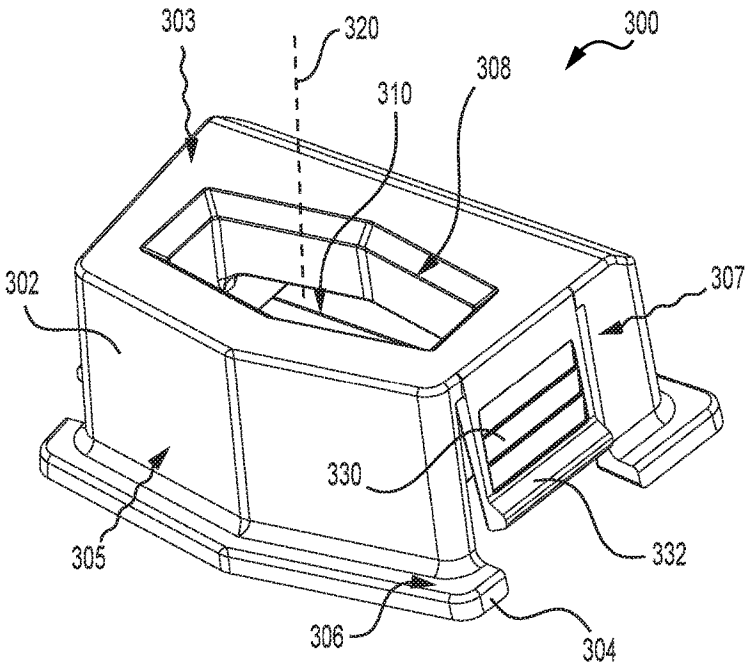
FIG. 15A is a top, left, rear side perspective view of a left anchor fixture, shown in isolation.

The left anchor fixture 300 is illustrated in isolation in FIGS. 15A and 15B and will be described herebelow. The right anchor fixture 300 is identical to the left anchor fixture 300. Front, rear, left and right sides of the left anchor fixture 300 are described relative to their position on the watercraft 20. As the right anchor fixture 300 is oriented facing an opposite direction than the left anchor fixture 300, its corresponding front, rear, left, and right sides will be a mirror image of those of the left anchor fixture 300. Only the left anchor fixture 300 will be described in detail below. It is contemplated that in some implementations the right and left anchor fixtures 300 may be not be identical. The anchor fixture 300 has a fixture body 302 with a top side portion 303, front and back side portions 307, and left and right side portions 305. The fixture body 302 also has a base 304. The base 304 includes a stopper portion 306 on a top side of the base 304, use of which will be described in detail below. The base 304 is integral with the fixture body 302, but it is contemplated that the base 304 and the fixture body 302 could be separate components mechanically connected together, such as by fasteners, for example. The fixture body 302 is made of any sufficiently stiff material, including, but not limited to, metal and hardened plastic.

An anchor aperture 308, designed for receiving an anchor 350 (described in detail later), is defined by the top portion 303 of the anchor fixture 300. The anchor aperture 308 leads downwards through the top portion 303 to an anchor chamber 310. The anchor aperture 308 is also employed by the user to move the retractable anchor fixture 300 from the retracted position to the extended position, as will be described below with respect to a method for using the retractable anchor fixtures 300. The anchor aperture 308 is oblong in shape and adapted for the anchor 350. It is contemplated that the anchor aperture 308 could be differently shaped to receive different implementations of the anchor 350. A central axis 320 of the anchor aperture 308 is defined generally normal to the anchor aperture 308 and extends generally along a vertical through the fixture 300 in the present implementation. It is contemplated that the anchor aperture 308 and the fixture body 302 could be of a more complicated form, and the actual angle of the central axis 220 of the anchor aperture 308 could vary from vertical.

A fastener aperture 314, designed for the insertion of a tongue fastener 415 (described in detail later) is defined in the right side surface 305 by the fixture body 302. The fastener aperture 314 communicates with the anchor chamber 310. A central axis 322 of the fastener aperture 314 is defined generally normal to the fastener aperture 314. The central axis is thus perpendicular to the central axis 320 of the anchor aperture and parallel to the base 304. It is contemplated that the central axes 320, 322 could be disposed at other angles to each other and/or to the anchor fixture base 304. In some implementations, it is further contemplated that the anchor fixture 300 may not provide the fastener aperture 314. In the retracted position, the fastener aperture 314 is not generally accessible to be used for receiving the tongue fastener 415, and the anchor fixture 300 will need to be moved to the extended position before use, as will be described below. The two retractable anchor fixtures 300 are arranged such that their fastener apertures 314 are facing each other (see for example FIG. 13). As mentioned above, however, the relative orientation of the fixtures 300 is not so limited.

The retractable anchor fixture 300 also includes a deformable, resilient tab 330 on each of the front and back side portions 307. The tabs 330 are integral to the fixture body 302 and extend generally downward from the top portion 303. It is contemplated that the tabs 330 could be separate components attached to the fixture body 302. The tabs 330 are used to help maintain the fixtures 300 in the extended position or the retracted position, as will be described below. Each tab 330 has a tab bottom portion 332 that protrudes outward from a bottom of the tab 330. It is contemplated that different resilient elements could be used in place of the tabs 330, including, but not limited to: spring-loaded deflectors and resilient hooks. It is also contemplated that the fixture body 302 could be connected to a separate system for retracting the anchor fixture 300, such as a spring and hook system.

Figure 14:
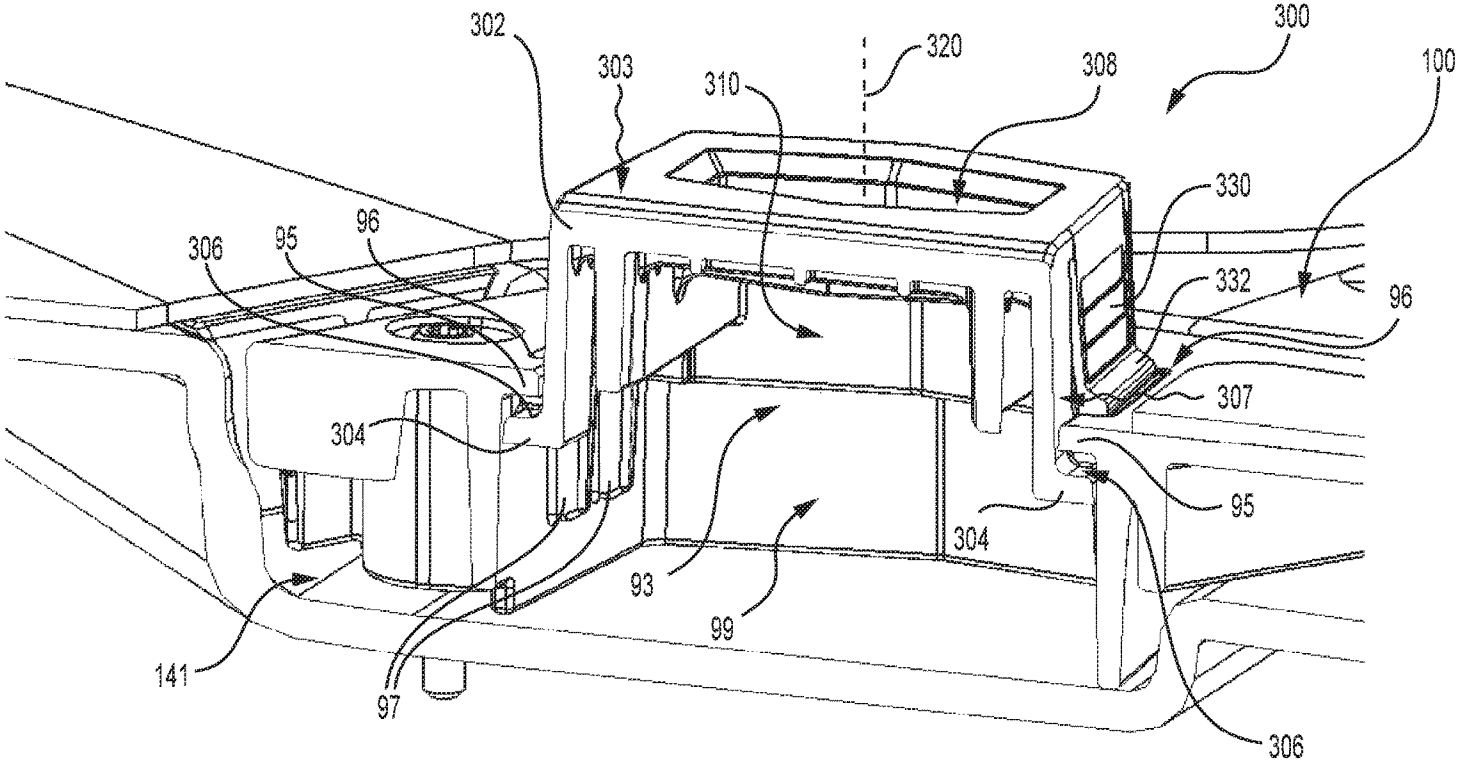
FIG. 14 is a perspective, cross-sectional view taken along line 14-14 of FIG. 13.

As can be seen from the cross-section of the left retractable anchor fixture 300 disposed in the personal watercraft 20 illustrated in FIG. 14, the tabs 330 and the stopper portions 306 aid in maintaining proper positioning of the retractable anchor fixture 300 in the recess 99 in the rear platform 100.

In the extended position, each tab 330 is received in a tab recess 96 defined in the edge 95 adjacent to the recess 99. The retractable anchor fixture 300 is generally prevented from falling back into the recess 99 from the extended position by the tabs 330 being held in the tab recesses 96. Additionally, the stopper portion 306 of the base 304 prevents the retractable anchor fixture 300 from being pulled out of the recess 99 (or being extended too far). When the fixture 300 is pulled upward into the extended position, the stopper 306 abuts the recess edge 95, preventing the fixture 300 from being removed from the watercraft 20. The recess edge 95 is thus wedged between the tab bottom portions 332 and the stopper portion 306 when the fixture is in the extended position. It is contemplated that the fixture 300 may only utilize the tab bottom portions 332 and the tab recess 96 to maintain the fixture 300 in the extended position.

To return the fixture 300 to the retracted position, the user pushes both the tabs 330 in toward the anchor chamber 310 until the tab bottom portions 332 are no longer engaged in the tab recesses 96. The fixtures 300 then can be slid in a generally downward direction into the recess 99. Four flanges 97 are provided along an interior of the recess 99 and are integral with the recess 99. Two flanges 97 protrude from a portion of a front wall of the recess 99 and two flanges 97 protrude from a portion of a rear wall of the recess 99. It is contemplated that more or less flanges 97 could be provided on one or more of the walls of the recess 99. The flanges 97 extend vertically and inward along the walls of the recess 99 and are generally aligned with the tabs 330. It is contemplated that the flanges 97 could have various forms and maintain their function as described below. It is contemplated that the tab bottom portions 332 and the tab recesses 96 could be sized and shaped such that a downward force applied to the fixture 300 results in the inward deflection of the tabs 330 and that, as such the fixture 300 may be returned to the retracted position simply by pushing it downwards with enough force to deform the tabs 330.

When the fixture 300 is in the retracted position, the tab bottom portion 332 of each tab 330 is situated below the flanges 97, such that the tabs 330 are not deflected by the flanges 97. In order to move the fixture 300 from the retracted position to the extended position, the fixture 300 must be pulled with enough force to deflect (temporarily deform) the tab bottom portion 332 inward to pass by the flanges 97. Further, the base 304 rests on a floor of the recess 141 to keep the fixture 300 from descending below the retracted position. It is contemplated that in some implementations, the fixtures 300 could be prevented from descending below the retracted position by additional stoppers or flanges. The fixture 300 is thus maintained in the retracted position until the user acts to move it to the extended position.

Further, the tabs 330 are flexed inward by the flanges 97 when the fixture 300 is between the extended position and the retracted position. Since the tabs 330 are resilient, the fixture 300 is not in a stable position and a restoring force from the tabs 330 will push the fixture 300 toward one of the extended and retracted positions. It is contemplated that the flanges 97 could provide additional stable and/or intermediate positions for the fixture 300.

Figure 16:
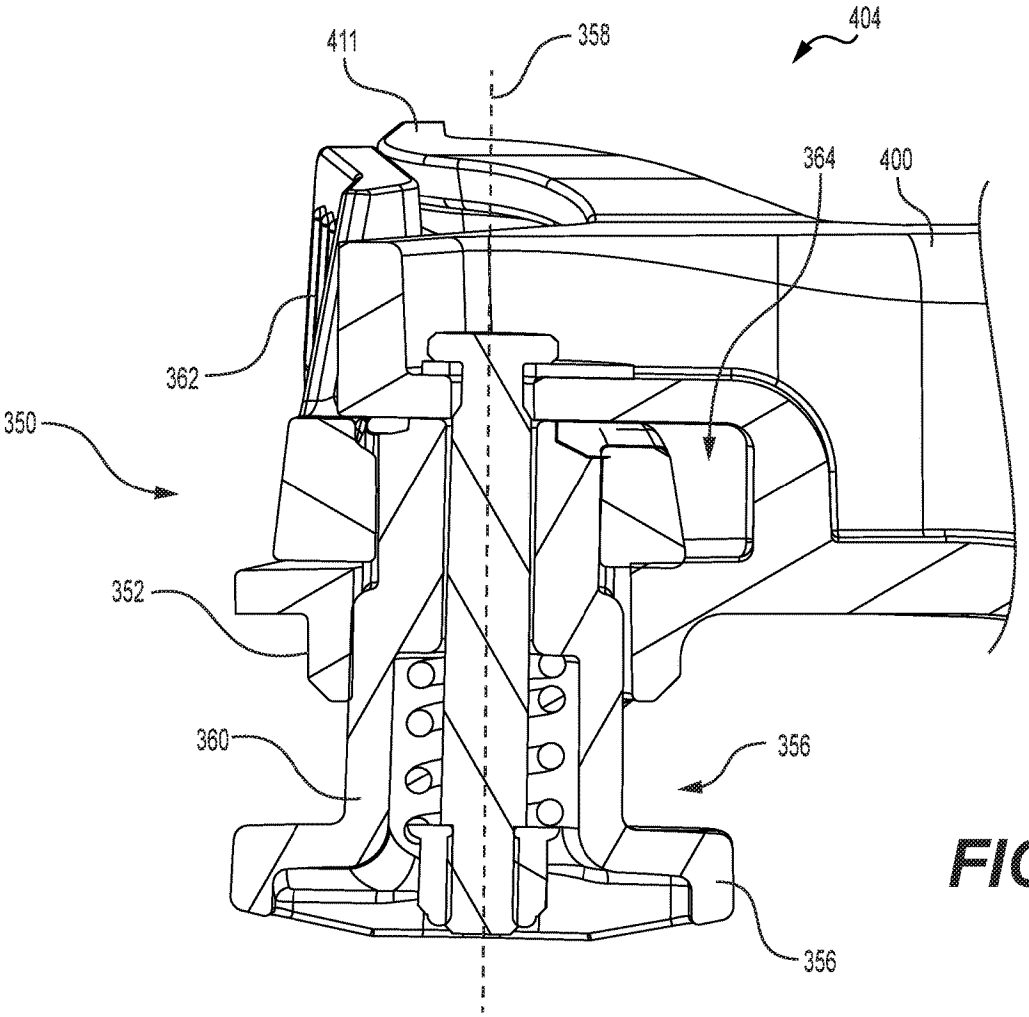
FIG. 16 is cross-sectional view of an attachment base and an anchor for connecting to the retractable anchor fixtures, with a strap covering a lever of the anchor removed for clarity.
Figure 17:
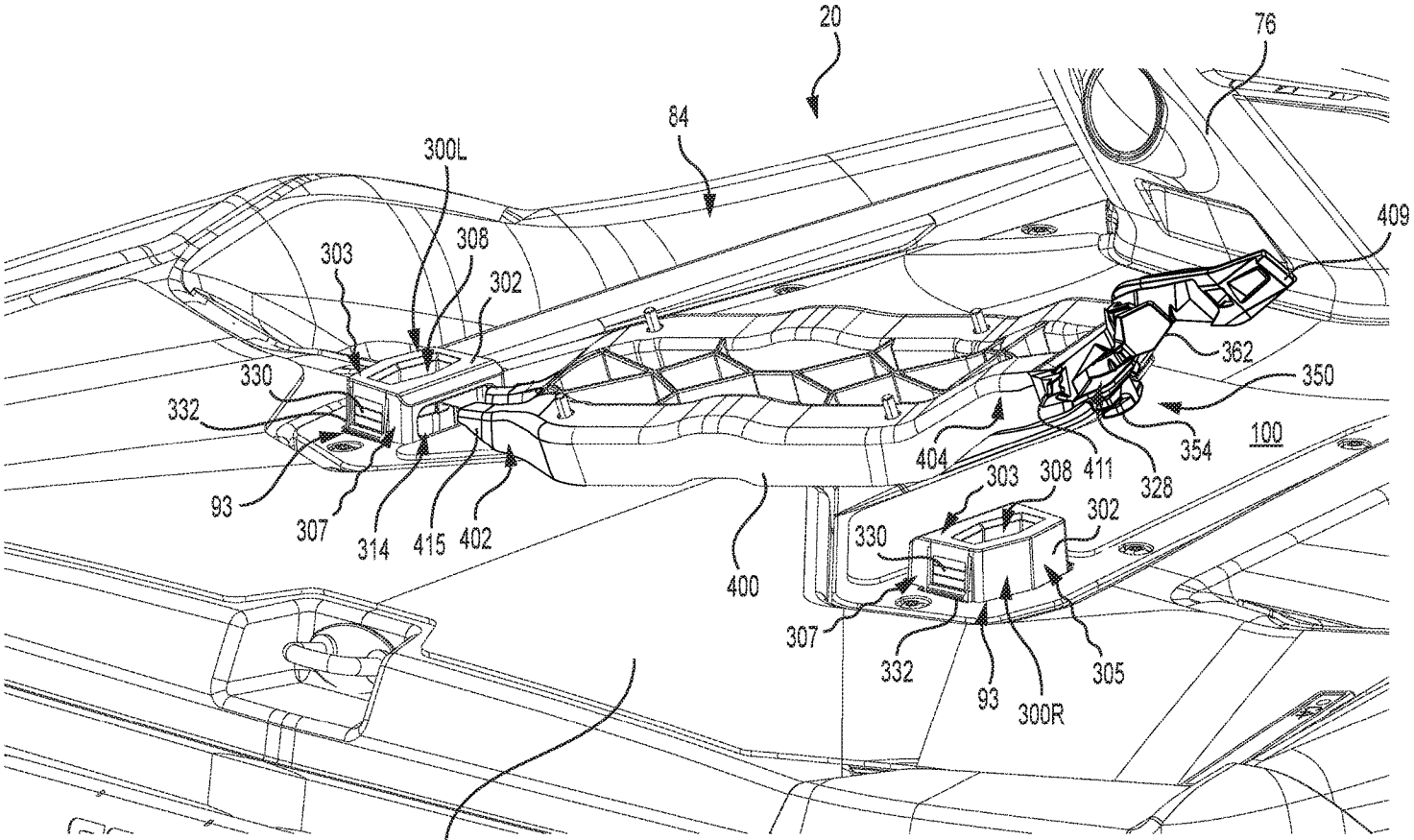
FIG. 17 is the top, right, rear side perspective view of a part of the rear platform of the personal water craft of FIG. 13, showing the attachment base and the anchor of FIG. 15A for connecting an accessory container.
Figure 18:
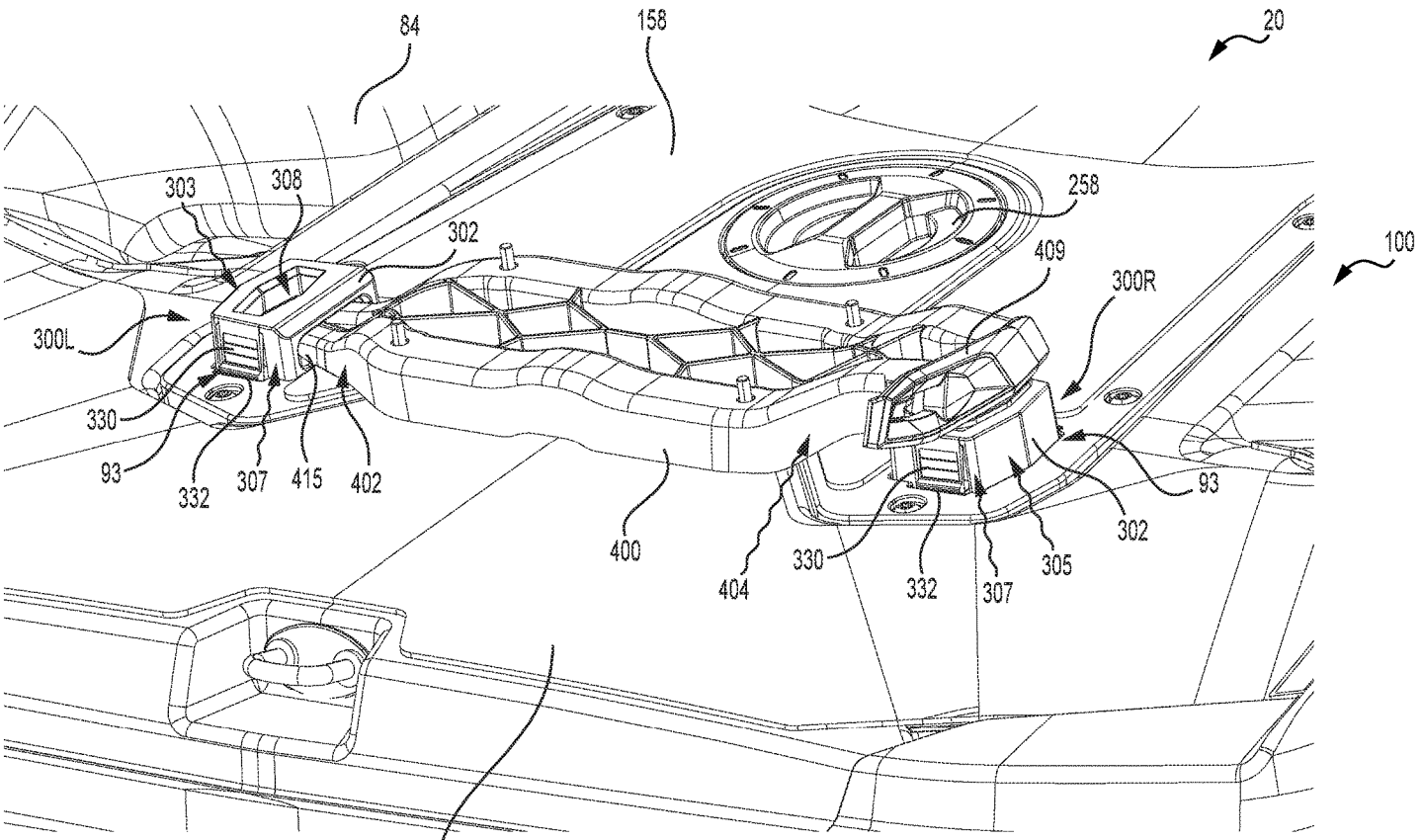
FIG. 18 is the top, right, rear side perspective view of FIG. 17 with the attachment base connected to the rear platform of the personal watercraft of FIG. 13.

The retractable anchor fixture 300 and the anchor 350 can be combined to form an anchor fixture system for vehicle accessories, which will now be described with reference to FIGS. 16 to 18. The anchor 350 is shown integral with an attachment base 400 in FIGS. 16 to 18; details of the attachment base 400 will be provided below. United States Patent Application Publication US20150210355, published on Jul. 30, 2015, the entirety of which is incorporated herein by reference, provides additional details regarding anchors and attachment bases similar in construction to the anchor 350 and attachment base 400. It is contemplated that in some implementations the anchor 350 could be a separate element used in cooperation with the retractable anchor fixture 300. In such an implementation, the attachment base 400 could have a hole adapted for receiving the anchor 350, the anchor 350 connecting to the retractable anchor fixture 300 upon passing through the hole.

The anchor 350 includes an anchor base 352 integrally formed with a right end portion 404 of the attachment base 400 and an anchor lock 354 extending from the anchor base 352. The anchor lock 354 and the anchor base 352 are separated by a space 356 wherein one or more surfaces can be held anchored together. The anchor base 352 and anchor lock 354 have an elongated shape. The anchor lock 354 is rotatable about an axis 358 perpendicular to the anchor base 352 between a locked position and an unlocked position that are separated by a quarter turn. In the unlocked position, the anchor lock 354 is disposed parallel to the anchor base 352, and in the locked position, the anchor lock 354 is disposed perpendicular to the anchor base 352. The anchor lock 354 extends from a stem 360 disposed along the axis 358. A lever 362 is rotatable about the axis 358 and is operatively connected to the anchor lock 354 to move the anchor lock 354 between the locked and unlocked positions. The end of the lever 362 that connects to the stem 360 is received in a space 364 defined in the attachment base 400. The locked and unlocked positions of the anchor 350 correspond to the anchor lock 354 being rotated by 90 degrees relative to the anchor base 352, and to the lever 362 being correspondingly turned by 90 degrees. It is contemplated that the anchor lock 354 could be turned by more or less than 90 degrees to engage the aperture 308 in one of the anchor fixtures 300. It is also contemplated that the lever 362 could be turned by a different angle than the anchor base 352 in order to move the anchor 350 between locked and unlocked positions.

The lever 362 is used to rotate the anchor lock 354 between the locked position and unlocked position as mentioned above. In the unlocked position of the anchor 350, the open lever 362 extends outwards from the frame 302. The lever 362 is turned in the groove 328 (FIG. 17) provided in the attachment base 400 for the lever 362 to lock the anchor 350. In the locked position of the anchor 350, the closed lever 362 is disposed adjacent to the frame 302 in the groove 328 and not extending outwards as in the unlocked position. Thus, when the anchor 350 is locked, the lever 362 is less likely to be accidentally pushed keeping the anchor 350 securely in the locked position. U.S. Pat. No. 8,777,531 B2, published on Jul. 15, 2014, and U.S. Pat. No. 8,875,830, published on Nov. 14, 2014, the entirety of both of which is incorporated herein by reference, provides additional details regarding anchors similar in construction to the anchor 350.

Cooperation of the anchor 350 and the retractable anchor fixture 300 to be used as the anchor fixture system for vehicle accessories will now be described. The elongated anchor lock 354 of the anchor 350 is inserted into the anchor chamber 310 through the anchor aperture 308 of the top portion 303. The anchor lock 354 selectively engages the bottom surface of the top portions 303 when rotated between the unlocked position and the locked position. The anchor aperture 308 is elongated to allow insertion of the elongated anchor lock 354 into the anchor chamber 310, and the anchor chamber 310 extends outwards from the anchor aperture 308 to allow rotation of the elongated anchor lock 354 within the anchor chamber 310.

A method for installing the vehicle accessory 450, as shown installed on the personal watercraft 20 in FIG. 12, using the anchor 350 and the tongue fastener 415 of the attachment base 400, and the anchor fixtures 300 for attaching the accessory 450 to the personal watercraft 20 will now be described with reference to FIGS. 17 and 18. It should be noted that the attachment base 400 is shown in isolation in FIGS. 17 and 18 for illustrative purposes. In normal operation, the attachment base 400 is connected to the accessory 450 and the below described procedure is carried out with the accessory 450 and the attachment base 400 connected together.

As described above, the anchor 350 is provided at the right end portion 404 of the attachment base 400. At a left end portion 402 of the attachment base 400, there is provided the tongue fastener 415 for connecting to another anchor fixture 300 on the personal watercraft 20. The anchor 350 and the tongue fastener 415 are integral to the attachment base 400. It is contemplated, however, that the anchor 350 and/or the tongue fastener 415 could be removably attached to the attachment base 400.

A rubber strap 409 is provided on the right side portion 404 of the attachment base 400 for covering the anchor 350 and is attached to the base 400 to one side of the anchor 350. The strap 409, when in a closed position, is hooked onto a tab 411 on the base 400 on another side of the anchor 350. The strap 409 is made of rubber, but it is contemplated that the strap 409 could be made of any flexible material. It is also contemplated that the strap 409 could be detachable from the base 400.

The attachment base 400 is connected to two oppositely facing retractable anchor fixtures 300L, 300R disposed in the rear platform 100 of the personal watercraft 20. These components can be seen just before connection in FIG. 17. FIG. 18 illustrates the attachment base 400 connected to the anchor fixtures 300L, 300R.

The right and left retractable anchor fixtures 300R, 300L are first pulled up by a user into the extended position. For each of the fixtures 300R/L, the user inserts their fingers into the anchor aperture 308, grasps an interior side of the top side portion 303, and pulls the fixture 300 in a generally upward direction until the tabs 330 exit the recess 99 and settle into the tab recesses 96.

The tongue fastener 415 is inserted into the fastener aperture 314 of the fixture 300L. The tongue fastener 415 is retained in the anchor chamber 310 by the edges of the fastener aperture 314 allowing the attachment base 400 to be braced against the anchor fixture 300L while it is installed into the anchor fixture 300R. The anchor 350 at the right end 404 of the attachment base 400 is then lowered into the anchor fixture 300R and inserted into the anchor aperture 308 of the anchor fixture 300R with the anchor 350 disposed in the unlocked position. The lever 362 is then turned to the locked position, as described above. Once the anchor 350 is inserted and locked, the rubber strap 409 is extended over the lever 362 and attached to the hook 411 on the other side of the anchor 350 as seen in FIG. 18.

The strap 409 is extended over the closed lever 362 and hooked to the tab 411 on the attachment base 400 on the other side of the anchor 350. In FIG. 18, the anchor 350 is in a locked position, the lever 362 is closed, and the strap 409 is attached over the anchor 350. When the lever 350 is unlocked, the strap 409 is left hanging loosely from the base 400, as seen in FIG. 17, and thereby providing a noticeable visual indication that the anchor 350 is unlocked.

It should be noted that while the method above was described with respect to the left fixture 300L receiving the tongue fastener 415 and the right fixture 300R receiving the anchor 350, the anchor fixtures 300 are mirror images of one another. These pairing could thus be reversed.

For an attachment base with a separate anchor 350, a right end of the attachment base is provided with a hole adapted for passing the anchor 350 therethrough. In the method above, after inserting the tongue fastener 415 into the fastener aperture 314 of the fixture 300L, the right end is lowered toward the fixture 300R, as above. The separate anchor 350 is then passed through the hole in the attachment base into the fixture 300R. The anchor 350 is then locked into place and the method continues as described above. It is contemplated that the separate anchor 350 could also be used with different accessories (without the accompanying attachment base). Further, the separate anchor 350 could be provided with holes for attaching, for example, hooks, bungee cords or tie-ropes. The separate anchor 350 could be connected to the fixture 300, as described above but without the attachment base, and then used to receive one or both ends of the bungee cord (for example).

Modifications and improvements to the above-described implementations of the present technology may become apparent to those skilled in the art. The foregoing description is intended to be exemplary rather than limiting. The scope of the present technology is therefore intended to be limited solely by the scope of the appended claims.

What is claimed is:

1. A retractable anchor fixture for vehicle accessories, the retractable anchor fixture being adapted for being movably disposed in a surface aperture in a vehicle surface, the retractable anchor fixture comprising:

a fixture body;

a fixture base extending from the fixture body, the fixture base including a stopper portion adapted for abutting an edge of the surface aperture;

a first aperture defined by the fixture body, the first aperture being adapted to receive therethrough a portion of an anchor for anchoring a first vehicle accessory to the anchor fixture; and an anchor chamber defined by the fixture body and communicating with the first aperture.

2. The retractable anchor fixture of claim 1, further comprising a second aperture defined at least in part by the fixture body and communicating with the anchor chamber, the second aperture being adapted to receive at least a portion of a fastener therein for fastening a second vehicle accessory to the anchor fixture.

3. The retractable anchor fixture of claim 1, further comprising at least one resilient element being adapted for aiding in maintaining the retractable anchor fixture in a first position or a second position.

4. The retractable anchor fixture of claim 1, wherein:

at least a portion of the anchor chamber is disposed outwardly of the first aperture in a direction perpendicular to a central axis of the first aperture; and the first aperture has an elongate shape.

5. The retractable anchor fixture of claim 2, wherein a central axis of the second aperture is generally perpendicular to a central axis of the first aperture.

6. The retractable anchor fixture of claim 1, wherein the first aperture is defined in a surface of the fixture body opposite to the fixture base.

7. The retractable anchor fixture of claim 1, wherein the first aperture is defined in a surface of the fixture body perpendicular to the fixture base.

8. The retractable anchor fixture of claim 7, wherein the second aperture is defined in a surface of the fixture body opposite to the fixture base.

9. An anchor fixture system for vehicle accessories comprising:

at least one anchor fixture according to claim 1;

at least one anchor having an anchor base and an anchor lock extending from the anchor base; and wherein:

the anchor is adapted to selectively engage the anchor fixture wherein at least a portion of the fixture body adjacent to the first aperture is held between the anchor lock and the anchor base;

the anchor lock is rotatable about an axis generally perpendicular to the anchor base between an unlocked position wherein the anchor lock is movable through the first aperture of the anchor fixture and a locked position wherein the anchor lock is prevented from being movable through the first aperture; and the anchor lock is rotatable in the anchor chamber, between the unlocked position and the locked position.

10. A vehicle, comprising:

a vehicle body having at least one external surface;

at least one seat connected to the vehicle body;

a propulsion system connected to the vehicle body;

at least one surface aperture being defined by the at least one external surface, the at least one surface aperture having an edge;

at least one retractable anchor fixture movably disposed in the at least one surface aperture, the at least one retractable anchor fixture comprising:

a fixture body;

a fixture base extending from the fixture body, the fixture base including a stopper portion for abutting at least a portion the edge of the at least one surface aperture;

a first aperture defined by the fixture body, the first aperture being adapted to receive therethrough an anchor of a first vehicle accessory; and an anchor chamber defined by the fixture body and communicating with the first aperture, a central axis of the anchor aperture being normal to the anchor aperture.

11. The vehicle of claim 10, wherein the at least one surface aperture is defined by at least one recess, the at least one recess being defined by the at least one external surface.

12. The vehicle of claim 11, wherein:

the at least one retractable anchor fixture is movable between at least an extended position and a retracted position;

in the retracted position, a top surface of the fixture body is generally aligned with, or generally below, a portion of the at least one external surface surrounding the edge of the at least one recess; and in the extended position, the stopper portion of the fixture base abuts the edge of the at least one recess.

13. The vehicle of claim 11, wherein the at least one retractable anchor fixture further comprises a second aperture defined at least in part by the fixture body and communicating with the anchor chamber, the second aperture being adapted to receive a portion of a fastener for fastening a second vehicle accessory to the anchor fixture.

14. The vehicle of claim 11, further comprising at least one flange disposed within the at least one recess; and wherein:

the at least one retractable anchor fixture further comprises at least one tab, the at least one tab being at least partially deformable, the at least one tab being generally aligned with the at least one flange.

15. The vehicle of claim 14, wherein:

a bottom portion of the at least one tab is disposed above the stopper portion; and when in the extended position:

the bottom portion of the at least one tab abuts a top side of the edge of the at least one recess, and the stopper portion abuts a bottom side of the edge of the at least one recess.

16. The vehicle of claim 13, wherein:

the at least one recess is a first recess and a second recess, the first and second recessed being defined by the at least one external surface, the first and second recesses being spaced by a gap; and the at least one retractable anchor fixture is a first retractable anchor fixture and a second retractable anchor fixture, the first retractable anchor fixture being disposed in the first recess and the second retractable anchor fixture being disposed in the second recess.

17. The vehicle of claim 16, wherein the first and second anchor fixtures are oriented with the second apertures facing each other.

18. The vehicle of claim 16, wherein the first and second anchor fixtures are oriented with the first apertures facing each other.

19. The vehicle of claim 11, wherein:

the vehicle is a personal watercraft;

the at least one recess is a pair of recesses defined in the rear platform; and the at least one retractable anchor fixture is a pair of retractable anchor fixtures disposed in the pair of recesses defined by the rear platform of the personal watercraft, the retractable anchor fixtures being disposed on opposite sides of the rear platform and oriented with their corresponding second apertures facing each other.

20. The vehicle of claim 19, wherein the at least one recess is a pair of recesses defined in the rear platform; and the at least one retractable anchor fixture is a pair of retractable anchor fixtures disposed in the pair of recesses defined by the rear platform of the personal watercraft, the retractable anchor fixtures being disposed on opposite sides of the rear platform and oriented with their corresponding first apertures facing each other.

* * * * *